US007981017B2

(12) United States Patent
Little et al.

(10) Patent No.: US 7,981,017 B2
(45) Date of Patent: Jul. 19, 2011

(54) MATERIALS FOR AND METHOD FOR MANUFACTURING RETAIL CONTAINER AND RESULTING RETAIL CONTAINER

(75) Inventors: Troy Little, Thomasville, PA (US); Jamie L. Laughman, East Berlin, PA (US)

(73) Assignee: York Container Company, York, PA (US)

( * ) Notice: Subject to any disclaimer, the term of this patent is extended or adjusted under 35 U.S.C. 154(b) by 0 days.

(21) Appl. No.: 12/502,659

(22) Filed: Jul. 14, 2009

(65) Prior Publication Data

US 2010/0247272 A1 Sep. 30, 2010

Related U.S. Application Data

(60) Provisional application No. 61/164,106, filed on Mar. 27, 2009.

(51) Int. Cl.

| | |
|---|---|
| ***B31B 1/00*** | (2006.01) |
| ***B31B 49/00*** | (2006.01) |
| ***B65D 5/50*** | (2006.01) |
| ***B65D 21/00*** | (2006.01) |
| ***B65D 5/00*** | (2006.01) |

(52) U.S. Cl. ..... 493/51; 493/69; 206/736; 206/509; 229/172

(58) Field of Classification Search ..... 206/509, 206/736; 229/915, 919, 122.32, 122, 33, 229/172, 164; 493/51, 79, 93, 84, 68, 69, 493/70

See application file for complete search history.

(56) References Cited

U.S. PATENT DOCUMENTS

| | | | |
|---|---|---|---|
| 499,654 | A | 6/1893 | Clark |
| 959,261 | A | 5/1910 | Reber |
| 2,002,618 | A | 5/1935 | Sutter |
| 2,134,964 | A | 11/1938 | Whitehead |
| 2,148,533 | A | 2/1939 | Chapman |
| 2,766,923 | A | 10/1956 | D'Esposito |
| 2,771,986 | A | 11/1956 | Bekoff |
| 2,884,179 | A | 4/1959 | Rossum |
| 2,894,672 | A | 7/1959 | Bamburg |
| 2,903,176 | A | 9/1959 | Crane |
| 2,922,552 | A | 1/1960 | Berger et al. |
| 2,939,620 | A | 6/1960 | Royce |
| 3,017,064 | A | 1/1962 | Davis |
| 3,034,698 | A | 5/1962 | Forrer |
| 3,048,318 | A | 8/1962 | Sabin |
| 3,155,234 | A | 11/1964 | Knoll et al. |
| 3,236,433 | A | 2/1966 | Barrett |
| 3,373,921 | A | 3/1968 | Crane |
| 3,397,831 | A | 8/1968 | Adams |
| 3,696,990 | A | 10/1972 | Dewhurst |
| 3,765,044 | A | 10/1973 | Hanahan et al. |
| 3,912,159 | A | 10/1975 | Danville |

(Continued)

FOREIGN PATENT DOCUMENTS

FR 2641758 7/1990

*Primary Examiner* — J. Gregory Pickett
*Assistant Examiner* — Kaushikkumar Desai
(74) *Attorney, Agent, or Firm* — Barnes & Thornburg LLP

(57) ABSTRACT

In accordance with the invention, a method of manufacturing containers such as shipping, display and display ready packaging, for example, and resulting containers and associated preassemblies and blanks are provided, which, when utilized, result in preassemblies that are more easily and quickly assembled into fully assembled containers including a plurality of stacking shoulder provided at opposing ends of the containers.

27 Claims, 23 Drawing Sheets

U.S. PATENT DOCUMENTS 3,982,684 A 9/1976 David
4,056,223 A 11/1977 Williams
4,058,249 A 11/1977 Buck
4,068,796 A 1/1978 Kullman, Jr.
4,197,980 A 4/1980 Johnson
4,403,729 A 9/1983 Wytko
4,497,408 A * 2/1985 Jes ..... 206/509
4,605,158 A 8/1986 Barton
4,709,852 A * 12/1987 Stoll ..... 229/119
4,874,125 A 10/1989 Bates
4,927,073 A 5/1990 Esposito
4,961,500 A 10/1990 Coulombe
5,114,034 A * 5/1992 Miller et al. ..... 220/7
5,125,568 A * 6/1992 Bauer ..... 229/172
5,213,220 A 5/1993 McBride
5,294,044 A 3/1994 Clark
5,315,936 A 5/1994 Smith
5,350,109 A 9/1994 Brown et al.
5,361,974 A * 11/1994 Earl et al. ..... 229/122.32
5,375,715 A 12/1994 Serre et al.
5,390,847 A * 2/1995 Young ..... 229/122.21
5,400,955 A 3/1995 Coalier et al.
5,415,345 A 5/1995 MacKinnon
5,505,368 A 4/1996 Kanter et al.
5,520,325 A 5/1996 Quaintance
5,673,848 A 10/1997 Garza
5,791,555 A 8/1998 Kanter
5,853,120 A 12/1998 McLeod
5,947,292 A 9/1999 Chelfi
5,957,294 A 9/1999 Kanter
5,975,413 A 11/1999 Moen
5,979,746 A 11/1999 McLeod et al.
6,015,084 A 1/2000 Mathieu et al.
6,068,140 A 5/2000 Mangrum et al.
6,085,969 A 7/2000 Burgoyne
6,138,904 A * 10/2000 Baird et al. ..... 229/149
6,158,653 A 12/2000 Kanter et al.
6,189,778 B1 2/2001 Kanter
6,189,780 B1 2/2001 Kanter
6,270,007 B1 8/2001 Jensen, Jr.
6,325,282 B1 12/2001 Kanter et al.
6,513,705 B1 2/2003 Sheffer
6,712,214 B1 * 3/2004 Wintermute et al. ..... 206/745
6,719,191 B1 * 4/2004 Christensen et al. .... 229/122.26
6,817,514 B2 11/2004 Kanter et al.
6,868,968 B1 * 3/2005 Casanovas ..... 206/509
6,874,679 B2 4/2005 Tibbles et al.
6,948,617 B2 9/2005 Kanter et al.
6,962,558 B2 11/2005 Dalrymple
7,066,379 B2 6/2006 McLeod et al.
7,290,696 B2 11/2007 McClure
2003/0146130 A1 8/2003 Kanter et al.
2005/0161496 A1 7/2005 McLeod et al.
2005/0189258 A1 9/2005 Vastola
2005/0242164 A1 11/2005 Teixidor Casanovas
2006/0060643 A1 3/2006 Sheffer
2006/0124712 A1 6/2006 Weimer, Jr.
2006/0196920 A1 9/2006 Moen
2007/0108261 A1 5/2007 Schuster
2007/0187346 A1 8/2007 Markson et al.
2008/0169339 A1 7/2008 Moser
2008/0169340 A1 7/2008 Sheffer
2008/0265726 A1 10/2008 Sheffer
2010/0083618 A1 4/2010 Little

* cited by examiner

MATERIALS FOR AND METHOD FOR MANUFACTURING RETAIL CONTAINER AND RESULTING RETAIL CONTAINER

CROSS REFERENCE TO RELATED APPLICATIONS

This application claims the benefit of priority to U.S. Provisional Patent Application No. 61/164,106 filed Mar. 27, 2009, the contents of which are incorporated herein by reference in their entirety.

FIELD OF THE INVENTION

The invention relates in general to the manufacture of containers that may be readily used to ship and/or display contents following delivery of the container, as specified in the independent claims.

BACKGROUND OF THE INVENTION

Various containers are conventionally provided as packaging for shipping or for display of product in a retail environment to prospective customers. As is conventionally known in the industry, such containers can be transported to manufacturing and/or retail environments for use in shipping or display in knock-down form, i.e., flattened but otherwise being glued, stapled or otherwise secured together, such that they are already substantially pre-assembled; such knock-down form containers are also referred to as preassemblies. In such a "knockdown" state (i.e., knocked down or not set-up), personnel assembling the product container need only open the sides and or ends of the container and affix the package bottom wall into its assembled condition. As a result, such containers' assembly may be performed such that the product can be placed into a resulting assembled container for shipping or as display package for ready display.

Conventionally, it has been deemed advantageous at times to stack a plurality of such containers, one on top of the other for the purposes of transport to a retail environment or during display or storage in the retail environment. In this use, it is necessary that the containers stacked above the bottom-most package are amply supported such that a stack of a number of such containers, when filled with product, will not collapse.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with illustrated embodiments, a method of manufacturing containers and resulting containers and associated preassemblies and blanks, which, when utilized, result in containers having an interior formed by a primary blank serving as an exterior of the container, the interior including a plurality of stacking shoulders formed by a supplementary blank at opposing ends of the container interior, wherein the plurality of stacking shoulders are formed as part of the set up or final assembly of exterior of the container.

Additionally, in accordance with illustrated embodiments, the plurality of stacking shoulders is formed by coupling of the primary and supplementary blanks at at least one side panel of the primary blank. Alternatively, or in addition, the plurality of stacking shoulders is formed by coupling of the primary and supplementary blanks at both the front side panel and the back side panel of the primary blank.

Further, in accordance with at least some illustrated embodiments, the stacking shoulders include one or more keys configured to provide horizontal alignment of stacked containers. In at least one embodiment of the invention, keys also interact with keyhole apertures provided on a bottom side of the containers, such that keys of a bottom most stacked container interact with the keyhole apertures provided on the container stacked above that container.

The illustrated embodiments of the invention have particular utility when used for the manufacture of preassemblies and associated containers that are flat bottomed tray type containers.

These illustrated embodiments are achieved by a combination of features recited in the independent claim. Accordingly, dependent claims prescribe further detailed implementations of the present invention.

BRIEF DESCRIPTION OF THE DRAWINGS

Various embodiments are described herein, by way of example only, with reference to the accompanying drawings. With specific reference now to the drawings, it should be understood that the particulars shown are by way of example and for purposes of discussion of illustrated embodiments only, and are presented in order to provide what is believed to be a useful and readily understood description of the principles and concepts of the invention. In this regard, no attempt is made to show structural details of the invention in more detail than is necessary for a fundamental understanding of the invention, the description taken with the drawings making apparent to those skilled in the art how the several forms of the invention may be embodied in practice.

Accordingly, a more complete understanding of the present invention and the utility thereof may be acquired by referring to the following description in consideration of the accompanying drawings, in which like reference numbers indicate like features, and wherein.

DETAILED DESCRIPTION OF THE INVENTION

Figure 1:
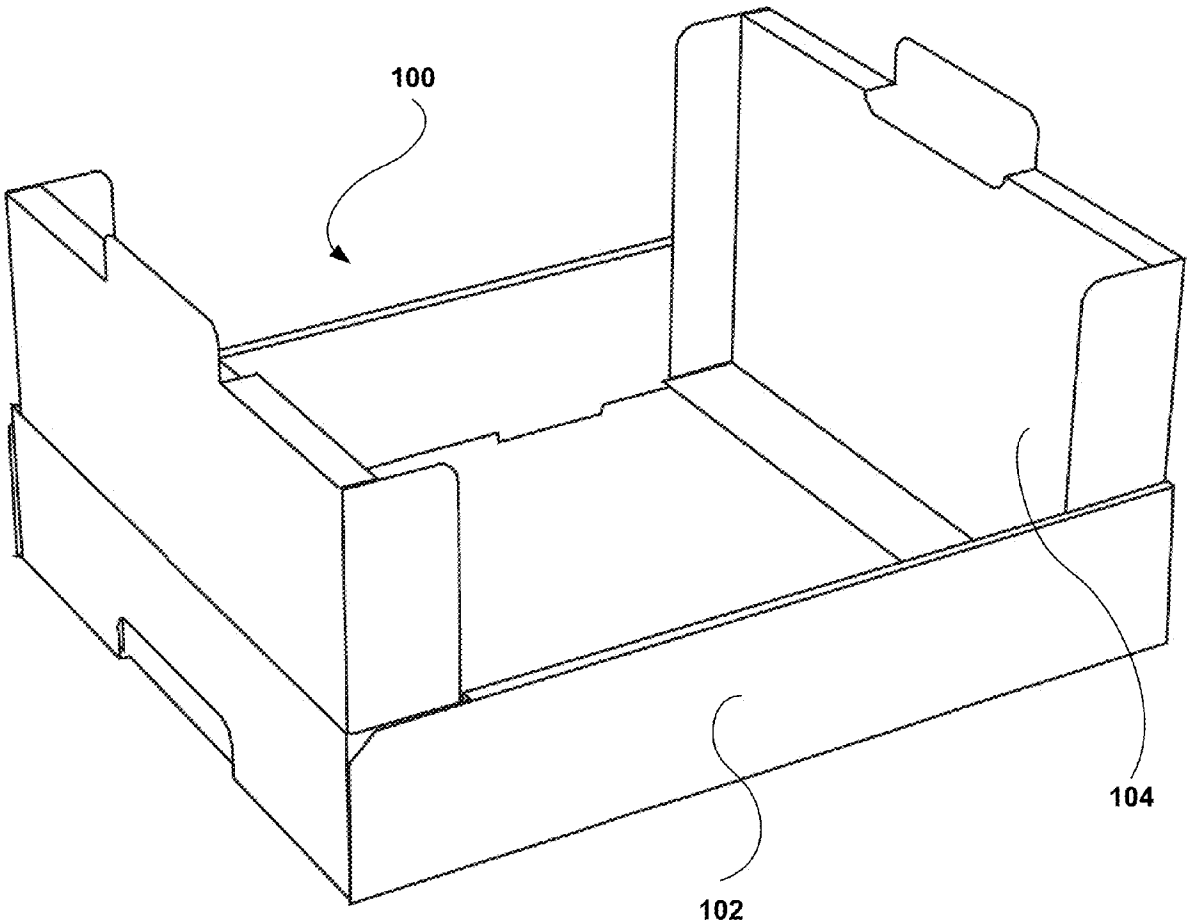
FIG. 1 illustrates a side perspective view of a container manufactured in accordance with an illustrated embodiment.

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

As explained above, it is useful to be able to stack a plurality of containers one on top of the other for the purposes of transport to a retail environment or during display in the retail environment. This ability (also known as "stackability") requires that containers stacked above the bottom-most package are amply supported also that a stack of a number of such containers, when filled with product, will not collapse.

Conventionally, there are various container designs that provide increased stackability by including, for example, stacking shoulders that utilize additional material and components to increase the vertical stability of the container. However, the skill level and time required for assembling such containers varies depending on the number of touches required for assembling the container. In fact, the time required for assembling conventional containers including stacking shoulders of some sort or another may be somewhat lengthy as assembly of a container may require a number of separate actions to be performed by the final assembler of a container. The number of such separate actions is conventionally referred to as the number of "touches" required for assembly; thus, a container requiring complex assembly requires a greater number of touches than a container requiring relatively simple assembly.

Another problem with such stackable containers is the increased height, length, width and weight of such containers due to the added material provided for the stacking shoulders. Therefore, although the use of such stackable containers is useful, the increased time for final assembly and increased dimensions and weight of the containers are deficiencies of conventional designs. Thus, there is a need for a design for a stackable container (e.g., a shipping package, display or display ready package or compartmentalized package so as to reduce fulfilment cost and time) that includes stacking shoulders with less affect on the overall dimensions and weight of the stackable container, while reducing the amount of material used in the container and reducing the number of touches required for final assembly of the container.

With this understanding in mind, a description of various embodiments is now provided.

According to at least one illustrated embodiment, there is provided equipment (described herein in connection with FIG. 8) configured to manufacture containers, e.g., for shipment or display of product (as well as corresponding container preassemblies and blanks) that result in containers having an interior formed by a primary blank serving as an exterior of the container, the interior including a plurality of stacking shoulders formed by a supplementary blank at opposing ends of the container interior, wherein the plurality of stacking shoulders are formed as part of the set up or final assembly of exterior of the container.

Understanding of the manufacturing of a container, blanks and/or preassemblies in accordance with embodiments may best be understood by first reviewing an illustration of a manufactured container provided in accordance with one illustrated embodiment. As illustrated in FIG. 1, one example of such a container 100 may be a flat bottomed tray container, which may include a main compartment defined between a plurality of stacking shoulders formed by a corresponding plurality of supplementary blanks 104 and included in an interior space of a primary blank 102 following assembly. These stacking shoulders may be formed by coupling the supplementary blanks 104 to locations on the primary blank 102. For example, as part of preassembly manufacture for a preassembly for container, the supplementary blank may be affixed to the primary blank as explained in connection with FIGS. 2-23 in various alternative configurations to provide for improved ease of final assembly for the container.

Such a container 100 may be used for various purposes including shipping and placement on a display floor along with other such containers in a stack. However, it should be understood that the manufactured container may be any type of container including, for example, any carton, package, box, etc. of any suitable type; accordingly, the actual configurations of the primary blank 102 and the interrelationship with the supplementary blank 104 may change without departing from the scope of the embodiments.

Thus, in accordance with illustrated embodiments, a method is provided of manufacturing containers and resulting containers 100 and associated preassemblies (the combination of 102, 104) and blanks 102, 104, which, when utilized, result in containers 100 that include a plurality of supplementary blanks 104 that provide a plurality of stacking shoulders that serve as a mechanism for improving the stackability of the container 100, whereby the container 100 may be configured to bare larger amounts of force (e.g., weight) applied from a top direction; in addition, the provision of the supplementary blanks 104 may also provide improved strength of the end panels of the resulting container 100 against force applied from side directions.

Based on the illustrated examples of container designs provided with stacking shoulders as disclosed herein, it should be appreciated that the incorporation of the stacking shoulders increases stackability of the resulting containers without requiring a lengthier time period for final assembly and without a need for assemblers having superior skill. This is because, as explained herein, the majority of manipulation of the preassembly to form the stacking shoulders are already performed as part of the assembly of the primary blank as the exterior of the container. As a result, the number of additional touches needed to provide the stacking shoulders is reduced relative to what is conventionally required.

Further, the illustrated examples of container designs provide stacking shoulders but with significantly less material than is conventionally required for stacking shoulders. This reduction in material results in a reduction in the container weight and resources expended to produce the container, while still providing improved strength.

As will be appreciated from the remaining disclosure by one of ordinary skill in the art, the container 100 may be used to ship or display product therein in a retail environment. Thus, subsequent to arrival at a retail environment or off-site fulfilment or contract packaging facility, a knockdown version of the container 100 (e.g., a preassembly) may be assembled and product placed in the container 100 for transport and/or display. Because FIG. 1 illustrates a container configured for use as a display container. However, it should be appreciated that additional panels may be included on/attached to the illustrated container for purposes of transporting the container. Accordingly, such panels may be removed from the container to provide the illustrated container of FIG. 1.

Figure 2:
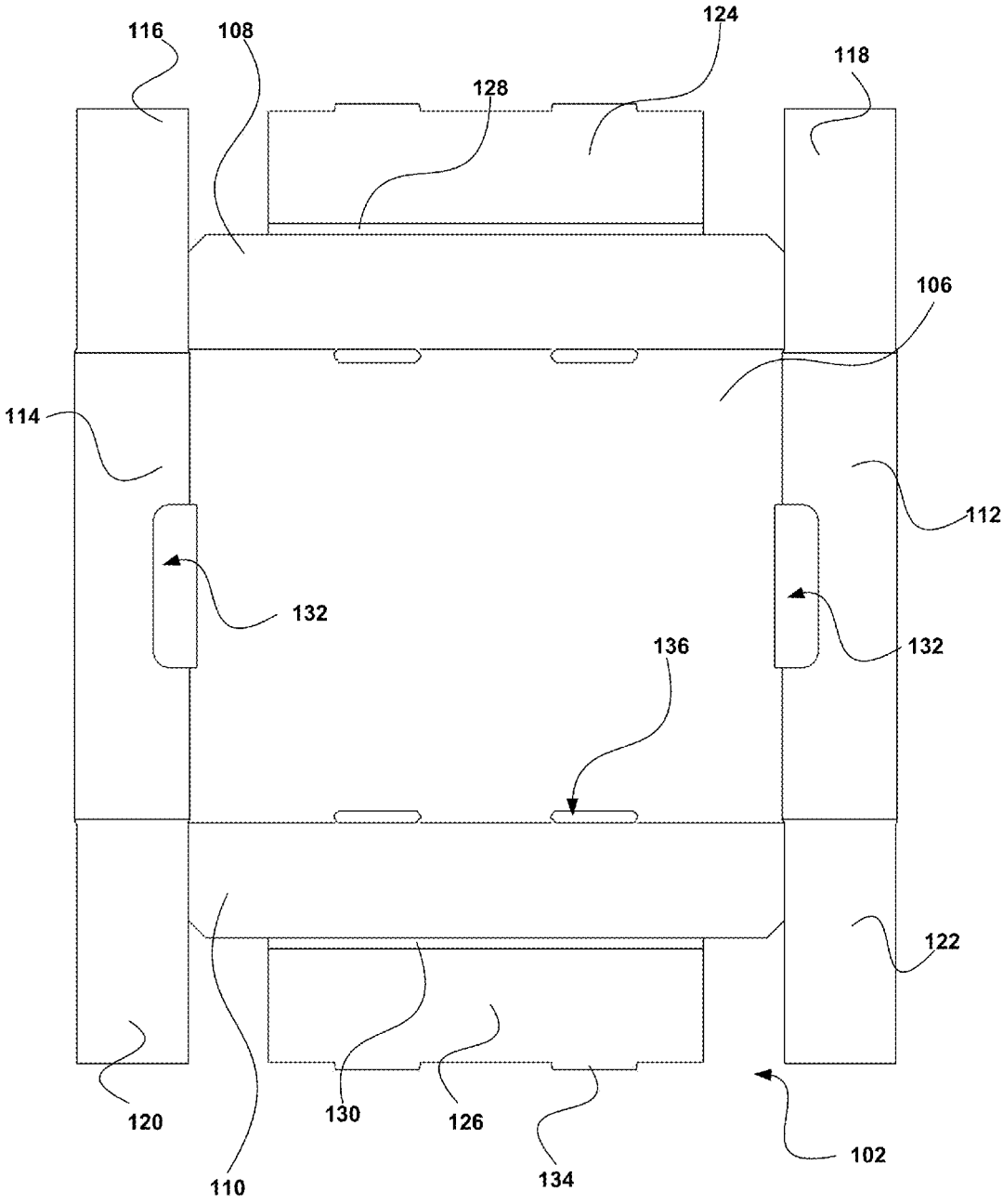
FIG. 2 illustrates an example of a primary blank used in manufacturing the container of the type illustrated in FIG. 1.

FIG. 2 illustrates an example of a primary blank 102, which may be thought of as a conventional tray type container such as the one illustrated in FIG. 1. The knockdown of the container 100 is manufactured by joining the primary blank 102 with a plurality of supplementary blanks 104 (which may be thought of as pads) illustrated in FIG. 3, as explained herein. The primary blank 102 illustrated in FIG. 2 corresponds to a majority of an exterior of the container 100 illustrated in FIGS. 1 and 7; therefore, the container 100 includes primary blank 102. Likewise, the container 100 also includes supplementary blanks 104 illustrated separately in FIG. 3 and in conjunction with primary blank 102 in FIGS. 4-7.

As shown in FIG. 2, the primary blank 102 includes a bottom panel 106, a back side panel 108, a front side panel 110 and end panels 112, 114. The back and front side panels 108, 110 and end panels 112, 114 are lateral panels that form the lateral enclosure of the container. Each end panel has corresponding end sub-panels; thus end panel 114 is connected to sub-panels 116, 120 and end panel 112 is connected to sub-panels 118, 122. Likewise, each side panel is connected to corresponding side sub-panels; therefore, back side panel 108 is connected to back side sub-panel 124 and front side panel 110 is connected to front side sub-panel 126.

When the primary blank is assembled as the exterior of the container 100, the two end panels 112, 114 are folded towards the bottom panel 106 and each of the sub-panels 116, 120 (corresponding to end panel 114) and 118, 122 (corresponding to end panel 112) are folded towards the bottom panel 106 as well. As a result, pairs of the end sub-panels 116, 118 and 120, 122 are parallel to one another and positioned on respective edges of the bottom panel 106 and the side panels 108 and 110. As a result, when the side panels 124, 126 are folded towards the side panels 108, 110 respectively and over the end sub-panels along fold lines 128, 130, the end sub-panels are positioned in place. Accordingly, when tabs 134 provided on the side sub-panels 124, 126 are inserted into corresponding apertures 136 provided along the edge of the bottom panel 106, the side panels and end panels are locked in place. This assembly process is discussed in further detail with reference to FIGS. 4-7.

Figure 3:
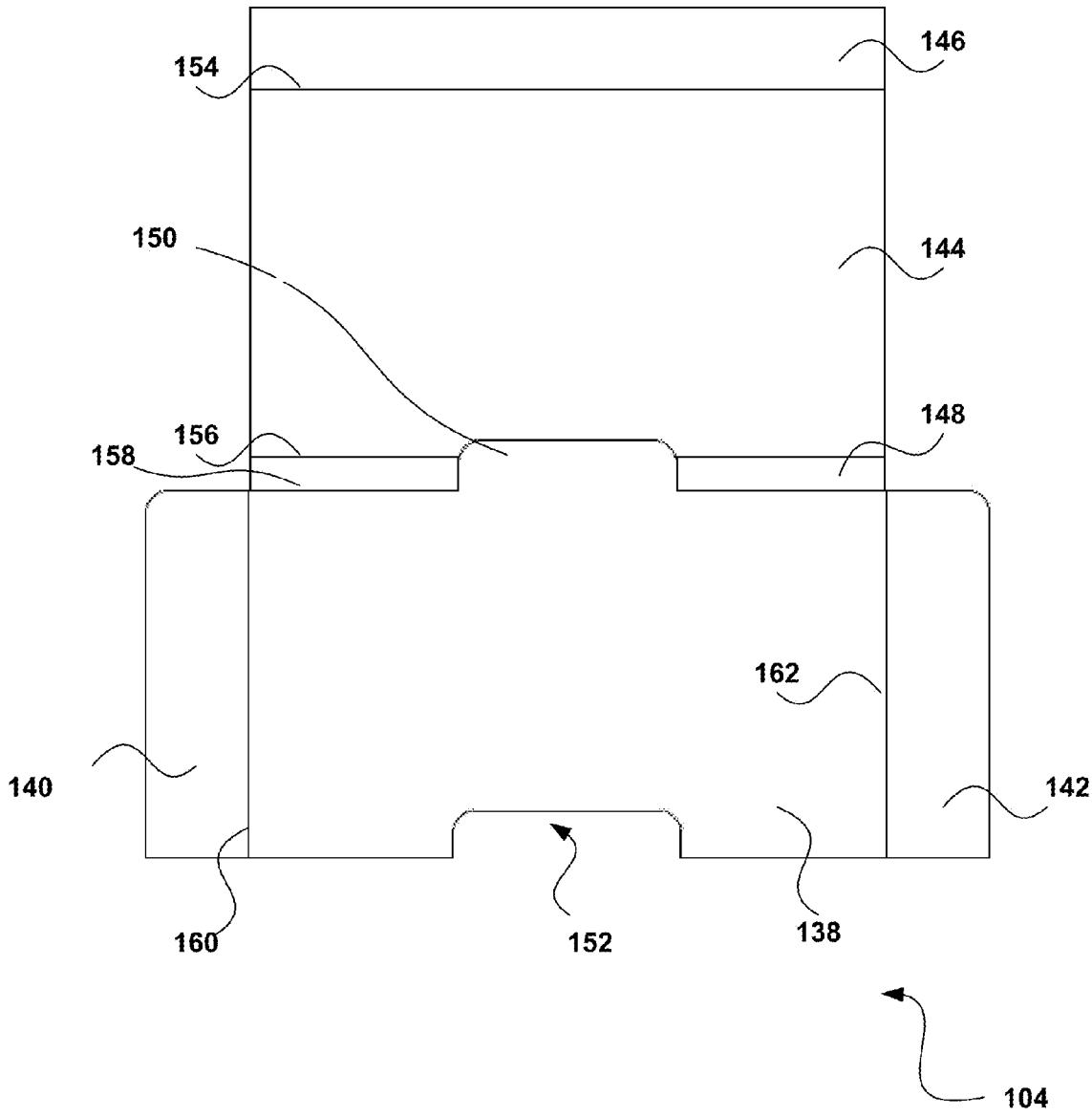
FIG. 3 illustrates an example of a supplementary blank used in manufacturing the container of the type illustrated in FIG. 1.

FIG. 3 illustrates an example of a supplementary blank 104 used in manufacturing the container of the type illustrated in FIG. 1. The supplementary blank 104 includes first and second major sections 138 and 144. The first major section 138 is attached to first sub-sections 140, 142; likewise the second major section 144 is attached to second sub-section 146. Sub-sections 140 and 142 actually form a portion of the exterior of the container 100. Sub-section 146 is provided as a point for attaching the supplementary blank 104 to the bottom panel 106 of the primary blank 102. Likewise, as discussed herein with reference to FIGS. 4-7, first major section 138 is also affixed to an end panel (112 or 114) of the primary blank. 102. Accordingly, during assembly of the container 100, the second major section 144 is folded towards the first major section 138 such that a shoulder section 148 is provided by the folding of the secondary blank 104 along fold lines 156, 158. As an additional result of this folding, the key 150 is formed on the upper side of the shoulder section 148. As mentioned briefly above and explained in further detail herein, the key 150 is configured to interact with the keyhole aperture (formed from the aperture 132 on the primary blank 102 and the aperture 152 on the supplementary blank 104, but referred to hereafter as keyhole aperture 152) provided on the underside of another container 100 following final assembly.

As explained above, illustrated embodiments may provide improved assembly of containers for shipping and/or display ready packaging that have increased stackability as a result of stacking shoulders formed by the interaction of the supplementary blank 104 with the primary blank 102 through at least one of adhering a plurality of parts of the supplementary and primary blanks to one another.

Figure 4:
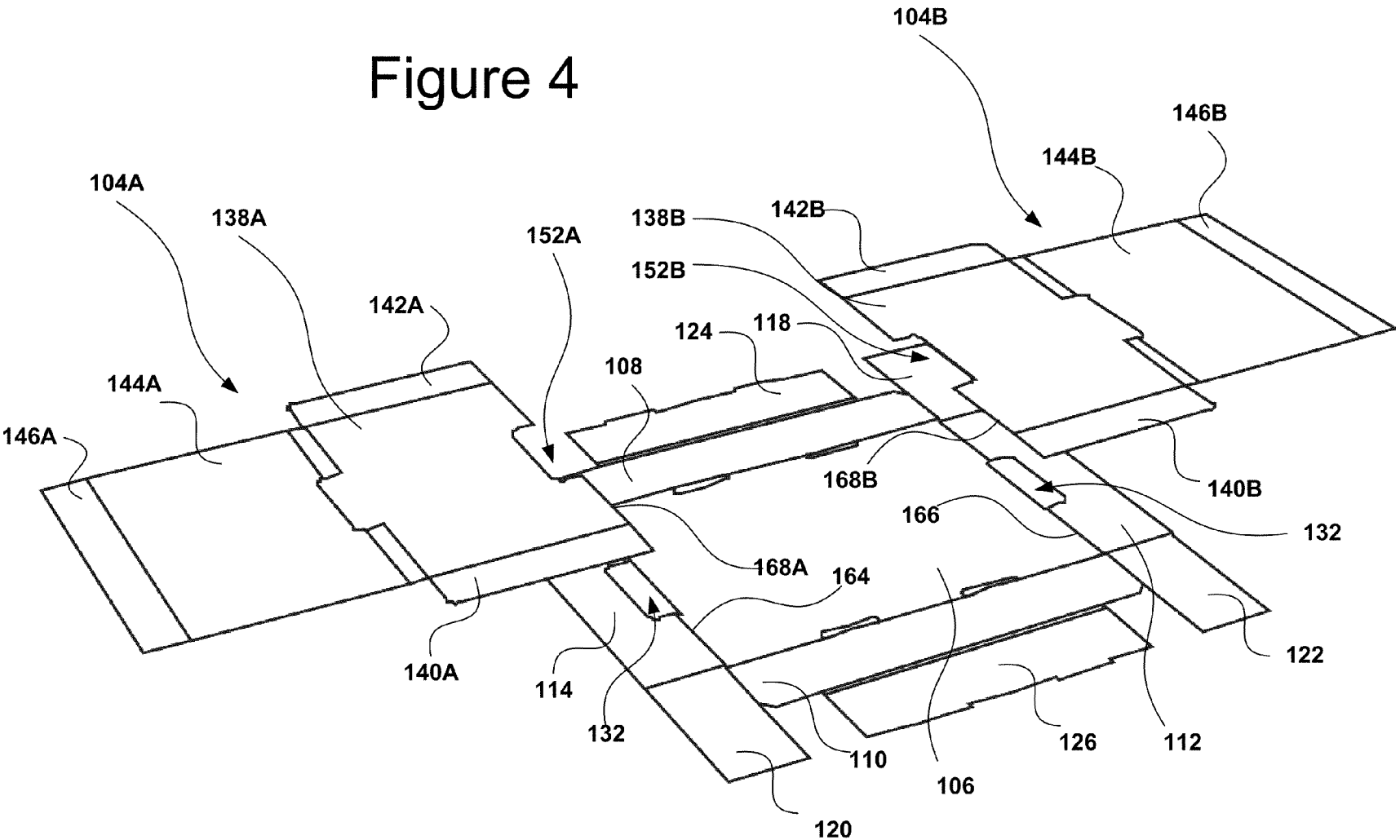
FIG. 4 illustrates the pre-assembly materials for the container of the type illustrated in FIG. 1 in a first stage of pre-assembly.

FIG. 4 illustrates the relative placement and interconnectedness of the primary and secondary blanks illustrated in FIGS. 2 and 3 to provide the container illustrated in FIG. 1. Accordingly, as illustrated in FIG. 4, the primary and supplementary blanks 102, 104 may be configured so as to interact in a manner that enables the stacking shoulders to be formed easily and quickly as part of the final assembly of the container 100. Accordingly, the total length and width dimensions for the blanks 102, 104 and their constituent panels, walls and sections may be selected so as to facilitate the positioning of the supplementary blanks 104 with respect to the interior of the assembled primary blank 102.

In one potential implementation, one or more portions of the primary and supplementary blanks 102, 104 may be affixed to one another via, for example, adhesive such as glue, staples, tape, etc. so as to produce a preassembly (e.g., a knockdown or preassembly for the container illustrated in FIG. 1), wherein the positioning of supplementary blank 104 in cooperation with primary blank 102 is controlled. For example, the primary and supplementary blanks 102, 104 may be affixed to each other on their mating faces (e.g., the bottom face of supplementary blanks 104 and the top face of the primary blank 102). More specifically, adhesive may be applied to that portion of the first major sections 138A, 138B of the supplementary blanks 104A, 104B that mate with the end panels 114, 112 of the primary blank 102. Additionally, and optionally, adhesive may be applied to a portion of sections 138A, 140A, 138B, 140B, 142A, and/or 142B; as a result, these sections may mate with and be affixed to panels 120, 116, 122, 118, as appropriate.

Subsequently, the sections 138A, 140A, 142A of supplementary blank 104A and sections 138B, 140B, 142B of supplementary blank 104B may be placed in contact with corresponding portions of the panels of the primary blank 102 during preassembly manufacture. More specifically, section 138A is placed in contact with panel 114, section 140A is placed in contact with panel 120 and section 142A is placed in contact with panel 116; likewise, section 138B is placed in contact with panel 112, section 140B is placed in contact with panel 122 and section 142B is placed in contact with panel 118. Thus, following application of adhesive, the supplementary blanks 104 may be placed in contact with the primary blank 102 to provide adherence between primary and supplementary blanks 102, 104.

As a result of such a process, a preassembly may be provided that which, when utilized, results in a container having an interior formed primarily by a primary blank 102 serving as an exterior of the container, the interior including a plurality of stacking shoulders formed by supplementary blanks 104 at opposing ends of the container interior, wherein the plurality of stacking shoulders are formed as part of the set up or final assembly of exterior of the container.

Thus, it should be appreciated that, as a first operation in manufacturing the preassembly for the container 100, the faces of the primary and supplementary blanks 102, 104 are affixed together at various locations. Thus, although not shown, a preassembly may be provided wherein the primary and supplementary blanks 102, 104 are affixed to one another via adhesive but the panels, walls, etc. are not configured for final assembly. As a result, such a preassembly may be delivered to a location for final assembly and placement of product; such a preassembly may be effectively and easily stacked with other preassemblies because such preassemblies are flat having not yet been built or assembled as shown in FIG. 1. Accordingly, it should be understood that the faces of the blanks 102, 104 may be affixed in one or more suitable manners including, for example but not limited to, application of adhesive on one or both of the affixed faces, use of staples, tape, etc.

Figure 5:
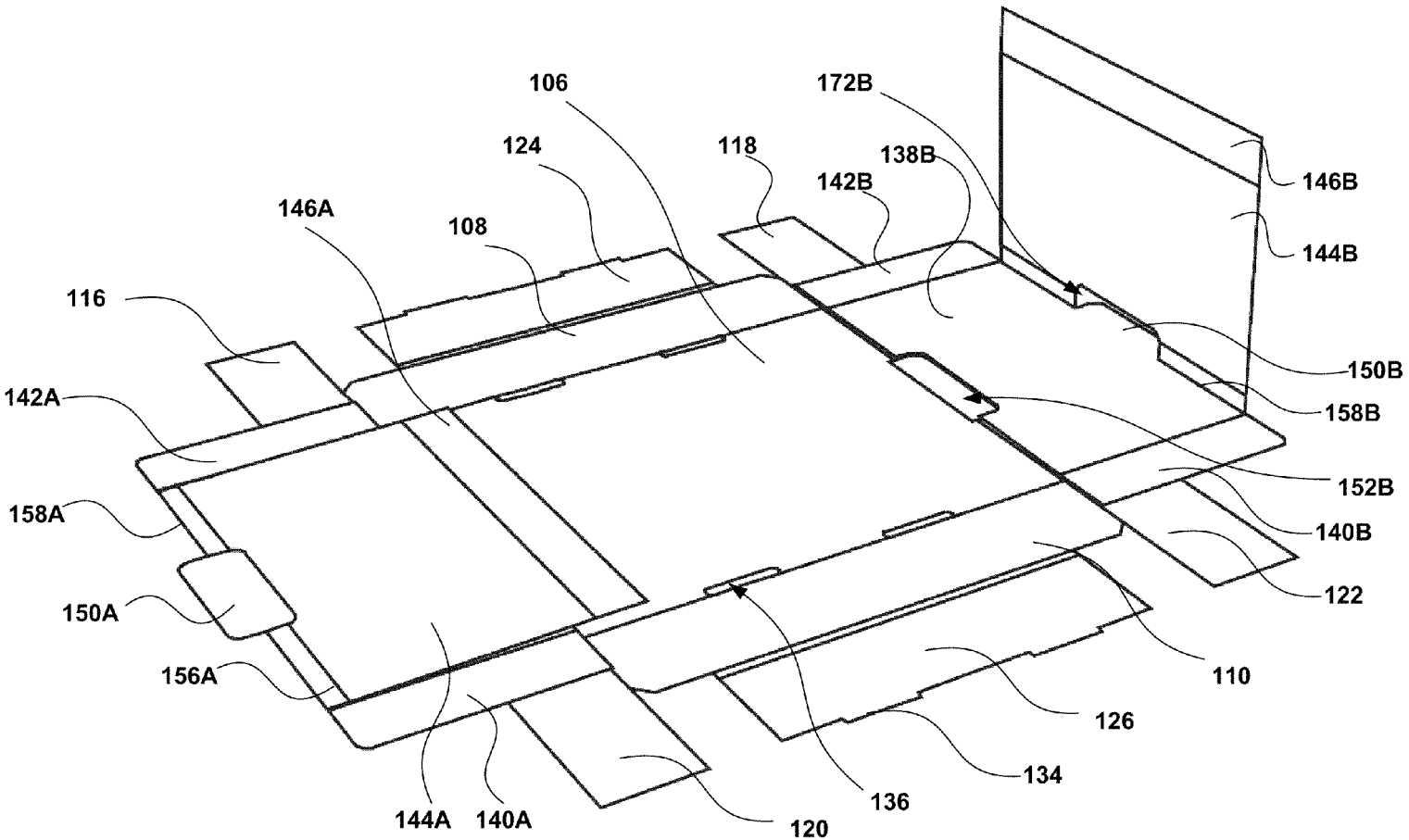
FIG. 5 illustrates the pre-assembly materials for the container of the type illustrated in FIG. 1 in a second stage of pre-assembly.
Figure 6:
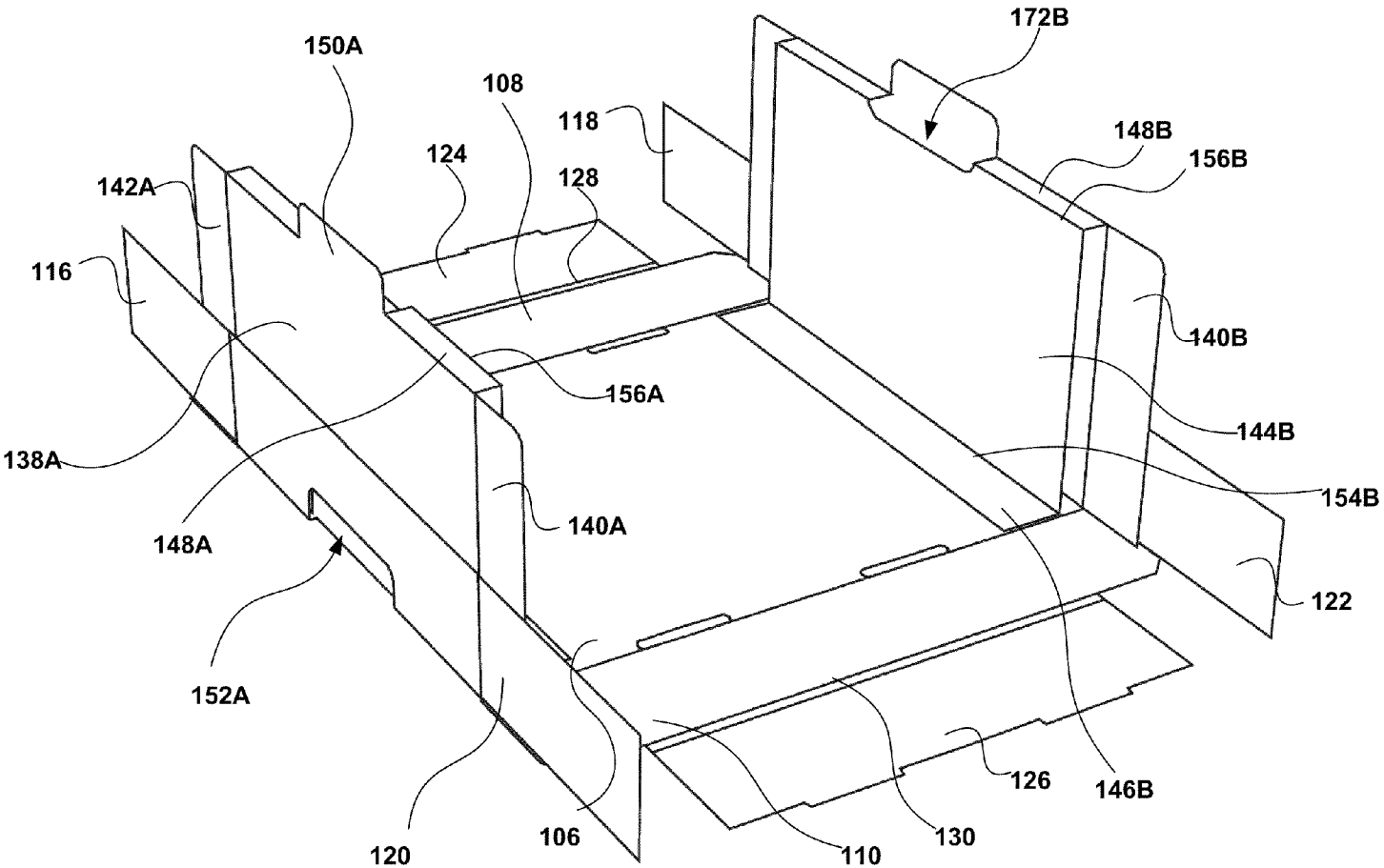
FIG. 6 illustrates the pre-assembly materials for the container of the type illustrated in FIG. 1 in a first stage of final assembly.

FIG. 5 illustrates a side perspective of the preassembly manufactured from the blanks illustrated in FIG. 4. As shown in FIG. 6, the supplementary blanks 104 are affixed to the primary blank 102 and located such that the second major sections 144A-B of the supplementary blanks 104A-B may be folded towards the first major sections 138A-B along fold lines 158A-B respectively. As a result of this folding, one face of each of the first major sections 138A-B meets a face of the corresponding second major sections 144A-B. Additionally, a face of each of the second sub-sections 146A-B meets the bottom panel 106 of the primary blank 102. Prior to this folding, adhesive has been applied to the face of each of the second sub-sections 146A-B meeting the bottom panel 106. As a result, when the faces meet the bottom panel 106, the adhesive acts to affix the second sub-sections 146A-B to the bottom panel 106. As a result of the adherence between the primary blank 102 and the supplementary blanks 104A-B a preassembly is provided that lays flat and is configured for shipping to a manufacturing or distribution center for final assembly.

FIG. 6 illustrates a side perspective of the preassembly manufactured from the blanks illustrated in FIG. 4 during final assembly. As shown in FIG. 6, the end panels 112, 114 are folded towards the bottom panel 106. As a result of this movement and the adherence between the end panels 112, 114 and the corresponding supplementary blanks 104A-B, the supplementary blanks form end walls of the container 100 together with the end panels 112, 114. Additionally, the sub-section pairs 116, 120 and 118, 120 respectively associated with each end panel 112, 114 are positioned so as to enable the pairs to folded so as to align with corresponding front and back sides of the container 100. More specifically, sub-sections 120 and 122 are folded so as to align with the edge between the bottom panel 106 and the front side panel 110; likewise, the sub-sections 116, 118 are folded so as to align with the edge between the bottom panel 106 and the back side panel 108.

Figure 7:
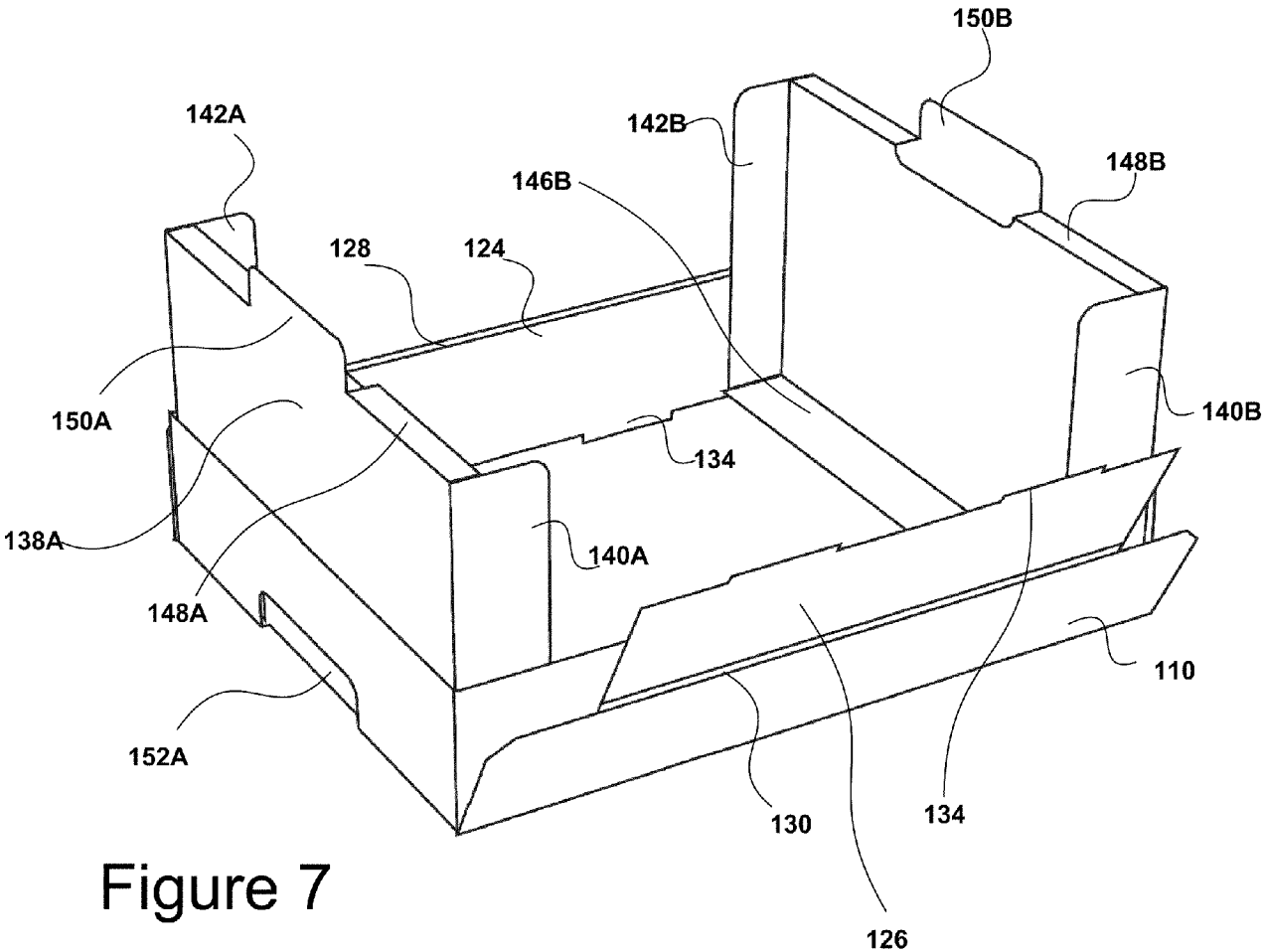
FIG. 7 illustrates the pre-assembly materials for the container of the type illustrated in FIG. 1 in a second stage of final assembly.

FIG. 7 illustrates the preassembly in a second stage of final assembly. As shown in FIG. 7, the front and back side panels 110, 108 are folded upward along the fold lines separating those panels from the bottom panel 106. Subsequently or simultaneously, the sub-panels 126, 124 are folded along fold lines 130, 128 over the corresponding sub-sections 120, 122 and 116, 118 respectively. The tabs 134 provided on each of the sub-panels 126, 124 are then inserted into the respective apertures 136. This interaction between the tabs 134 and the apertures locks the sub-sections 120, 122 and 116, 118 into place along with the erected front and back side panels 110, 108 to form front and back side walls of the container 100 as shown in FIG. 1.

As shown in FIG. 7, the stacking shoulders are formed at opposing ends of the container 100 by the first and second major sections 138A-B, 144 A-B coupled together by the shoulder sections 148A-B respectively. The shoulders are secured in place by the adhesive provided between the 146A-B and the bottom panel 106 as well as the interaction between the sub-sections 116,118 and 120, 122 and the corresponding back and front side panels 108, 110 and associated sub-panels. As a result of the force exerted on the first major sections 138A-B during erection of the end walls, the keys 150A-B are forced to disengage from the shoulder sections 148A-B (having been provided by a perforation during manufacturing of the supplementary blank 138). These illustrated keys 150A-B are configured to interact respectively with the keyhole apertures 152A-B provided on other non-illustrated containers 100 stacked above the container 100. Likewise, the illustrated keyhole apertures 152A-B are configured to interact respectively with the keys 150A-B provided on other non-illustrated containers 100 stacked below the container 100.

As a result of such a process, a preassembly may be provided which, when utilized, results in a container having an interior formed primarily by a primary blank serving as the majority of the exterior of the container; the container interior includes a plurality of stacking shoulders formed by the supplementary blanks at opposing ends of the container interior, wherein the plurality of stacking shoulders are formed as part of the set up or final assembly of exterior of the container.

Accordingly, the inclusion of stacking shoulders is implemented with minimal effort and deviation from the assembly required for the exterior of the container. Thus, stacking shoulders may be provided with improved ease and consistency as part of final assembly of a container exterior.

Figure 8:
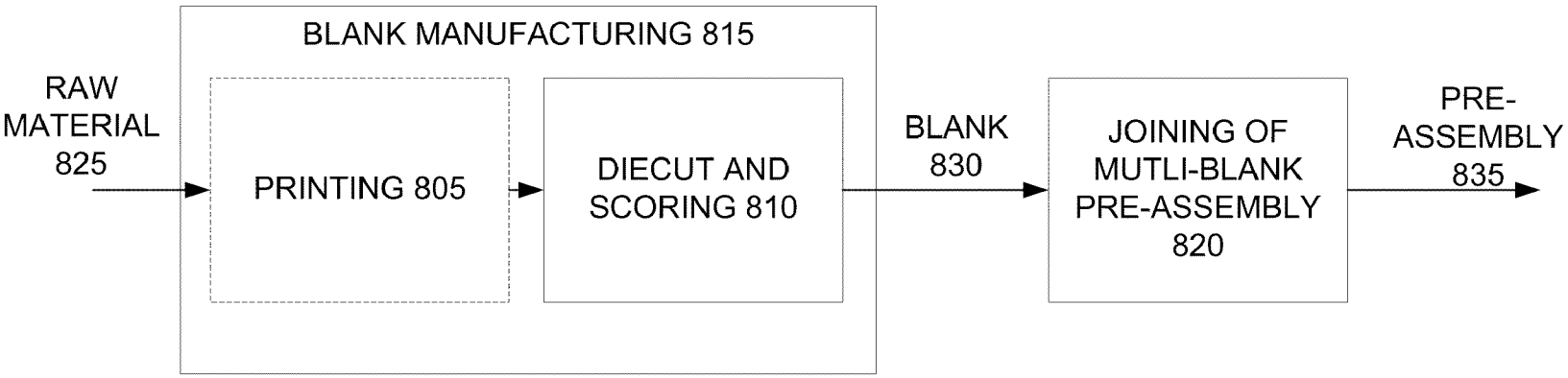
FIG. 8 illustrates a functional block diagram used to describe the manufacturing method of containers in accordance with an illustrated embodiment.

FIG. 8 illustrates a functional block diagram used to describe the manufacturing method of containers in accordance with an illustrated embodiment. As alluded to in the background section, and as conventionally known, the manner of manufacturing containers such as the examples illustrated in FIGS. 1-7 may be conveniently described in two phases: preassembly and final assembly/use.

Preassembly is normally performed at a container manufacturing facility to produce a preassembly which may also be thought of and referred to as a knockdown of the container. These preassemblies may be shipped to a customer location such as a product manufacturing facility or retail environment or third party fulfilment contract packaging facility. At that destination, the container customer may perform final assembly/use of the containers by, for example, folding and assembling various panels of the container to provide a container that is configured to hold manufacture product, e.g., for shipping and/or display.

In such operations, the manufacturing of the container preassemblies may be performed by the customer of the preassemblies and/or as part of manufacture of the preassemblies as illustrated in FIG. 8.

FIG. 8 illustrates various functional operations performed as part of the manufacture of a preassembly by, for example, a display, shipping or display ready packaging manufacturer. The operations may begin, for example, with printing 805 of container material prior to the container material being die cut and/or scored 810 as part of an overall blank manufacturing operation 815. The manufactured blanks 830 may or may not be printed on one or both sides of the blanks 830 depending on customer requirements. Accordingly, the printing operation 805 may be omitted.

Subsequent to blank manufacturing 815, the manufactured blanks may be affixed to one another as part of the joining of multi-blank preassembly operations 820. The operations performed at 820 may be performed in various suitable manners including by hand or using various commercially available machines (for example, those produced by Bahmueller Technologies, Inc. of Charlotte, N.C., USA or Bobst Group North America of Roseland, N.J., USA). Thus, the operations performed at 820 may produce preassemblies for containers such as that illustrated in FIGS. 3-7.

Therefore, it should be appreciated that one or more of the operations performed to produce blanks, preassemblies, knockdowns and containers may be performed in whole or in part by machines and or human personnel. Moreover, human personnel may utilize one or more different types of machines and/or tools to perform assembly operations performed either to manufacture preassemblies or finally assembled containers.

Thus, at the beginning of such operations, raw material 825 is used to produce blanks 830. Such raw materials 825 may include but are not limited to various grades, types, configurations and combinations of corrugated fiberboard and/or solid paperboard, liner board, board of various fluting types and combinations as well as various types of sealants, non-organic materials and inks and dies of various suitable types.

Figure 9:
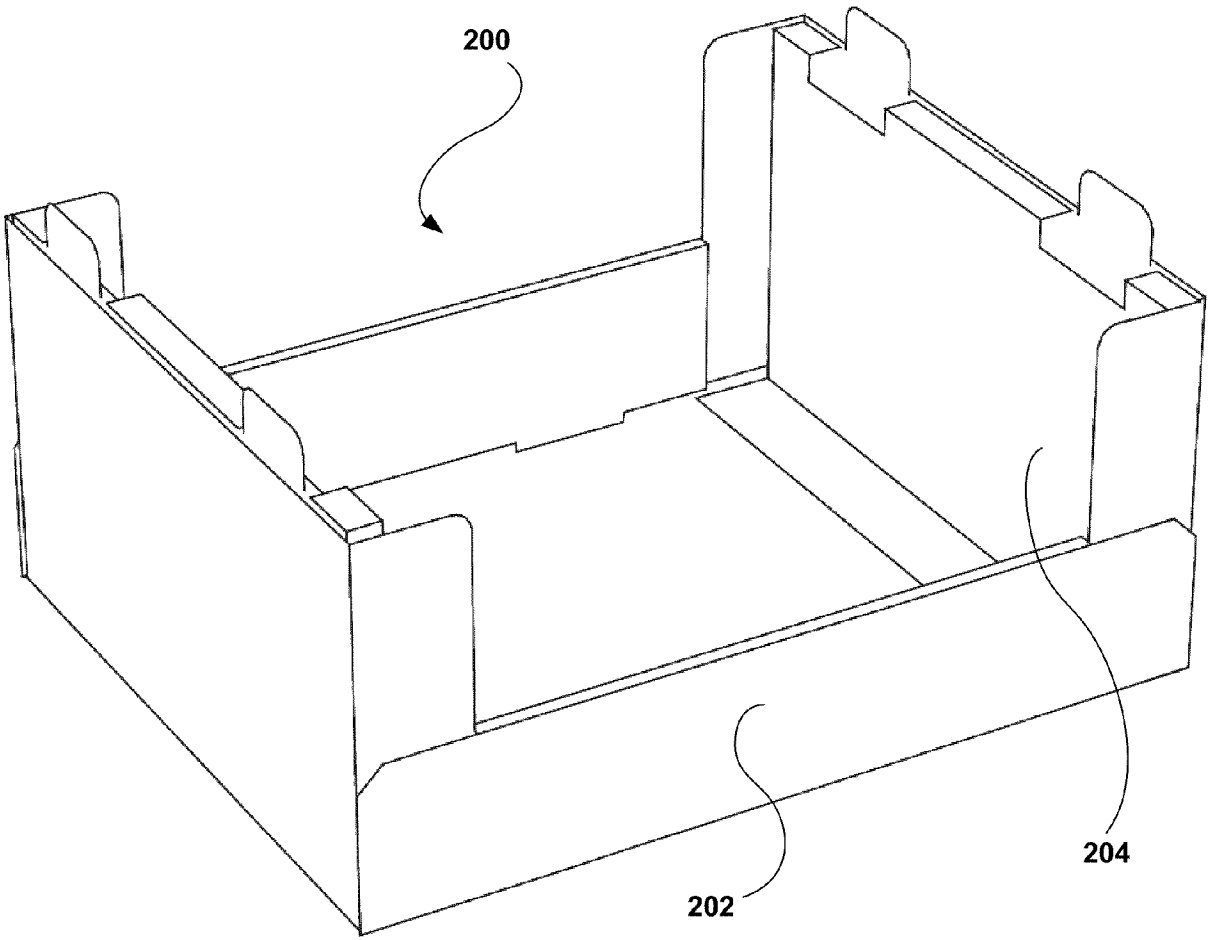
FIG. 9 illustrates a side perspective view of a container manufactured in accordance with another illustrated embodiment.

While this invention has been described in conjunction with a specific embodiment outlined above, it is evident that many alternatives, modifications and variations will be apparent to those skilled in the art. For example, as illustrated in FIG. 9, another example of a container 200 may be a flat bottomed tray container, which may also include a main compartment defined between a plurality of stacking shoulders formed by a corresponding plurality of supplementary blanks 204 and included in an interior space of a primary blank 202 following assembly. As in the first illustrated embodiment, these stacking shoulders may be formed by coupling the supplementary blanks 204 to locations on the primary blank 202. The primary differences between the first illustrated embodiment and that illustrated in FIG. 9 are that the embodiment of FIG. 9 includes two keys 250 and the associated keyhole apertures 233 are configured somewhat differently. Additionally, the relative dimensions of the primary blank 202 are also different, e.g., the dimensions of the end panels 212, 214.

Accordingly, the container 200 may be used for various purposes including shipping and placement on a display floor along with other such containers in a stack. However, it should be understood that the manufactured container may be any type of container including, for example, any carton, package, box, etc. of any suitable type; accordingly, the actual configurations of the primary blank 202 and the interrelationship with the supplementary blank 204 may change without departing from the scope of the embodiments.

Thus, in accordance with illustrated embodiments, a method is provided of manufacturing containers and resulting containers 200 and associated preassemblies (the combination of 202, 204) and blanks 202, 204, which, when utilized, result in containers 200 that include a plurality of supplementary blanks 204 that provide a plurality of stacking shoulders that serve as a mechanism for improving the stackability of the container 200, whereby the container 200 may be configured to bare larger amounts of force (e.g., weight) applied from a top direction; in addition, the provision of the supplementary blanks 204 may also provide improved strength of the end panels of the resulting container 200 against force applied from side directions.

The container 200 may be used to ship or display product therein in a retail environment. Thus, subsequent to arrival at a retail environment or off-site fulfilment or contract packaging facility, a knockdown version of the container 200 (e.g., a preassembly) may be assembled and product placed in the container 200 for transport and/or display. Because FIG. 9 illustrates a container configured for use as a display container. However, it should be appreciated that additional panels may be included on/attached to the illustrated container for purposes of transporting the container. Accordingly, such panels may be removed from the container to provide the illustrated container of FIG. 9.

Figure 10:
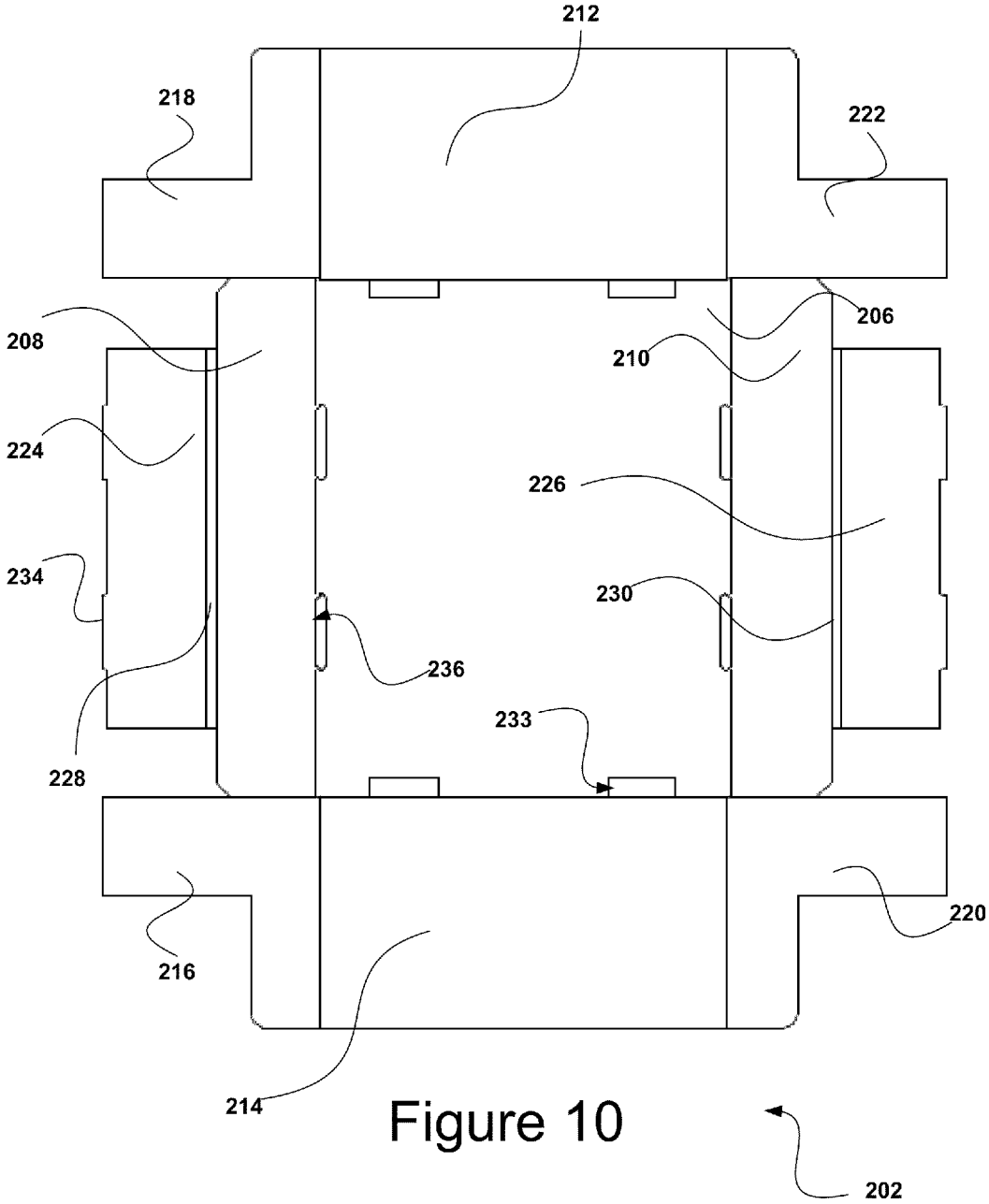
FIG. 10 illustrates an example of a primary blank used in manufacturing the container of the type illustrated in FIG. 9.

FIG. 10 illustrates an example of a primary blank 202, which may be thought of as a conventional tray type container such as the one illustrated in FIG. 9. The knockdown of the container 200 is manufactured by joining the primary blank 202 with a plurality of supplementary blanks 204 (which may be thought of as pads) illustrated in FIG. 11, as explained herein. The primary blank 202 illustrated in FIG. 10 corresponds to an exterior of the container 200 illustrated in FIG. 9; therefore, the container 200 includes primary blank 202 and supplementary blanks 204 illustrated separately in FIG. 11 and in conjunction with primary blank 202 in FIGS. 12-14.

As shown in FIG. 10, the primary blank 202 includes a bottom panel 206, a back side panel 208, a front side panel 210 and end panels 212, 214. Each end panel has corresponding end sub-panels; thus end panel 214 is connected to sub-panels 216, 220 and end panel 212 is connected to sub-panels 218, 222. Likewise, each side panel is connected to corresponding side sub-panels; therefore, back side panel 208 is connected to back side sub-panel 224 and front side panel 210 is connected to front side sub-panel 226.

When the primary blank is assembled as the exterior of the container 200, the two end panels 212, 214 are folded towards the bottom panel 206 and each of the sub-panels 216, 220 (corresponding to end panel 214) and 218, 222 (corresponding to end panel 212) are folded towards the bottom panel 206 as well. As a result, pairs of the end sub-panels 216, 218 and 220, 222 are parallel to one another and positioned on respective edges of the bottom panel 206 and the side panels 208 and 210. As a result, when the side panels 224, 226 are folded towards the side panels 208, 210 respectively and over the end sub-panels along fold lines 228, 230, the end sub-panels are positioned in place. Accordingly, when tabs 234 provided on the side sub-panels 224, 226 are inserted into corresponding apertures 236 provided along the edge of the bottom panel 206, the side panels and end panels are locked in place. This assembly process is discussed in further detail with reference to FIGS. 12-14.

Figure 11:
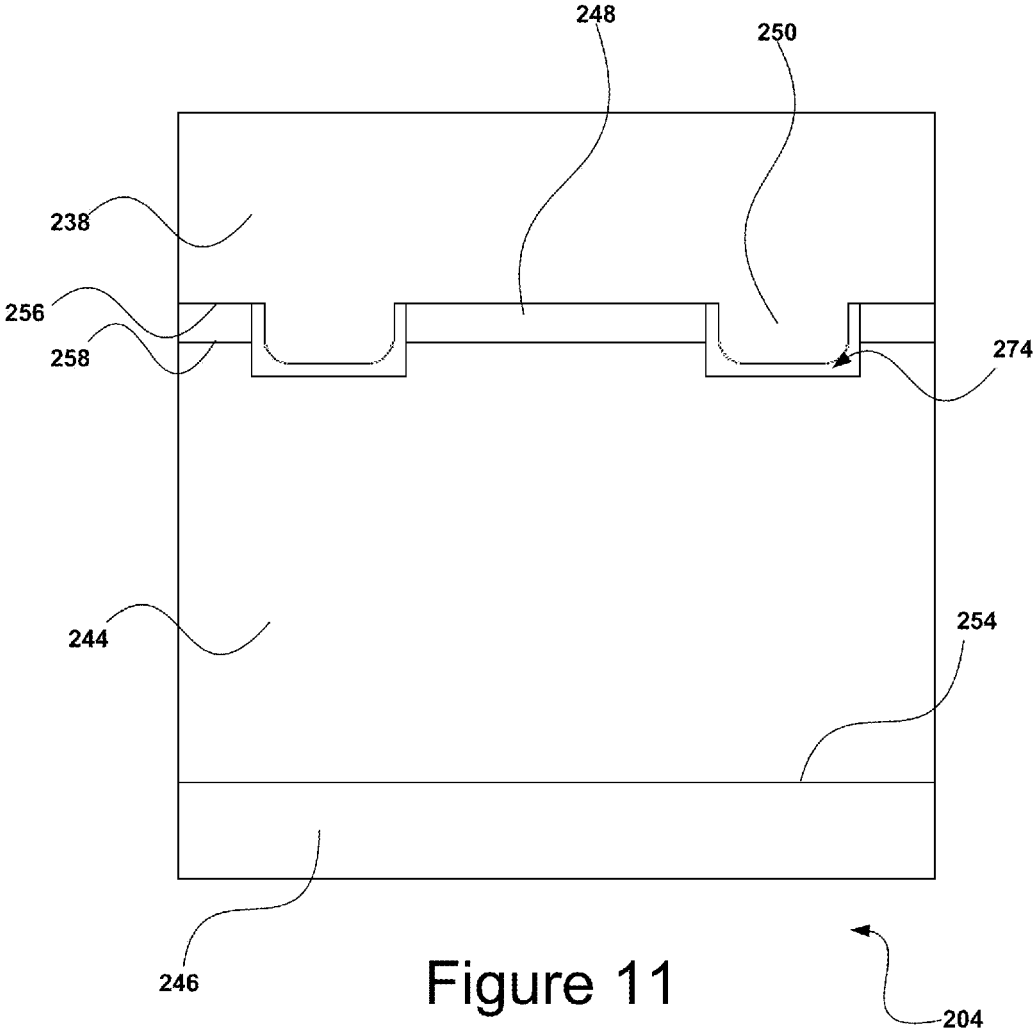
FIG. 11 illustrates an example of a supplementary blank used in manufacturing the container of the type illustrated in FIG. 9.

FIG. 11 illustrates an example of a supplementary blank 204 used in manufacturing the container of the type illustrated in FIG. 9. The supplementary blank 204 includes first and second major sections 238 and 244. The second major section 244 is attached to sub-section 246, which is provided as a point for attaching the supplementary blank 204 to the bottom panel 206 of the primary blank 202. Likewise, as discussed herein with reference to FIGS. 13-14, first major section 238 is also affixed to an end panel (212 or 214) of the primary blank. 202. Accordingly, during assembly of the container 200, the first major section 244 is folded towards the second major section 238 such that a shoulder section 248 is provided by the folding of the secondary blank 204 along fold lines 256, 258. As an additional result of this folding, the keys 250 are formed on the upper side of the shoulder section 248. As mentioned briefly above and explained in further detail herein, the keys 250 are configured to interact with the keyhole apertures 233 provided on the underside of another container 200 following final assembly.

Figure 12:
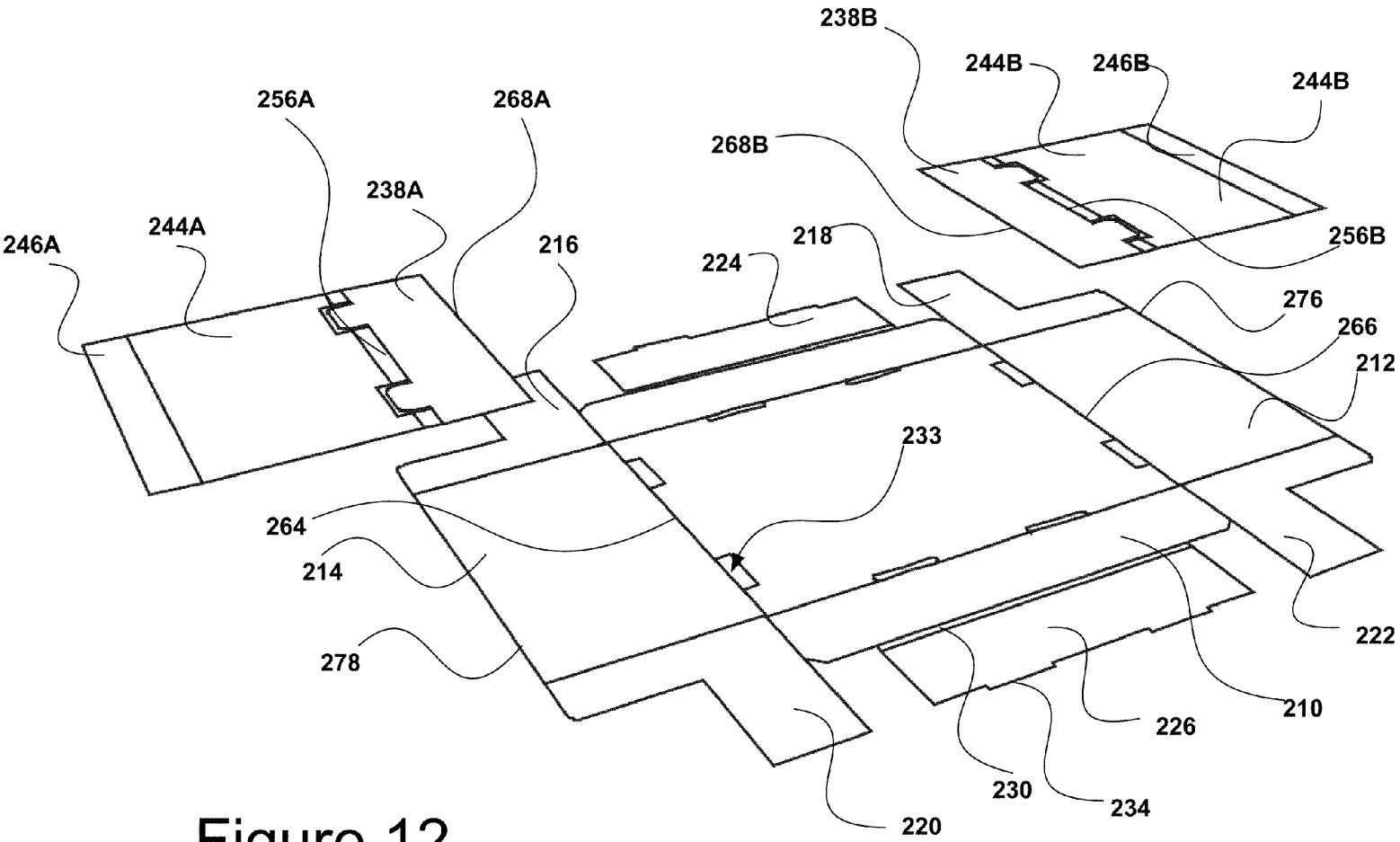
FIG. 12 illustrates the pre-assembly materials for the container of the type illustrated in FIG. 9 in a first stage of pre-assembly.
Figure 13:
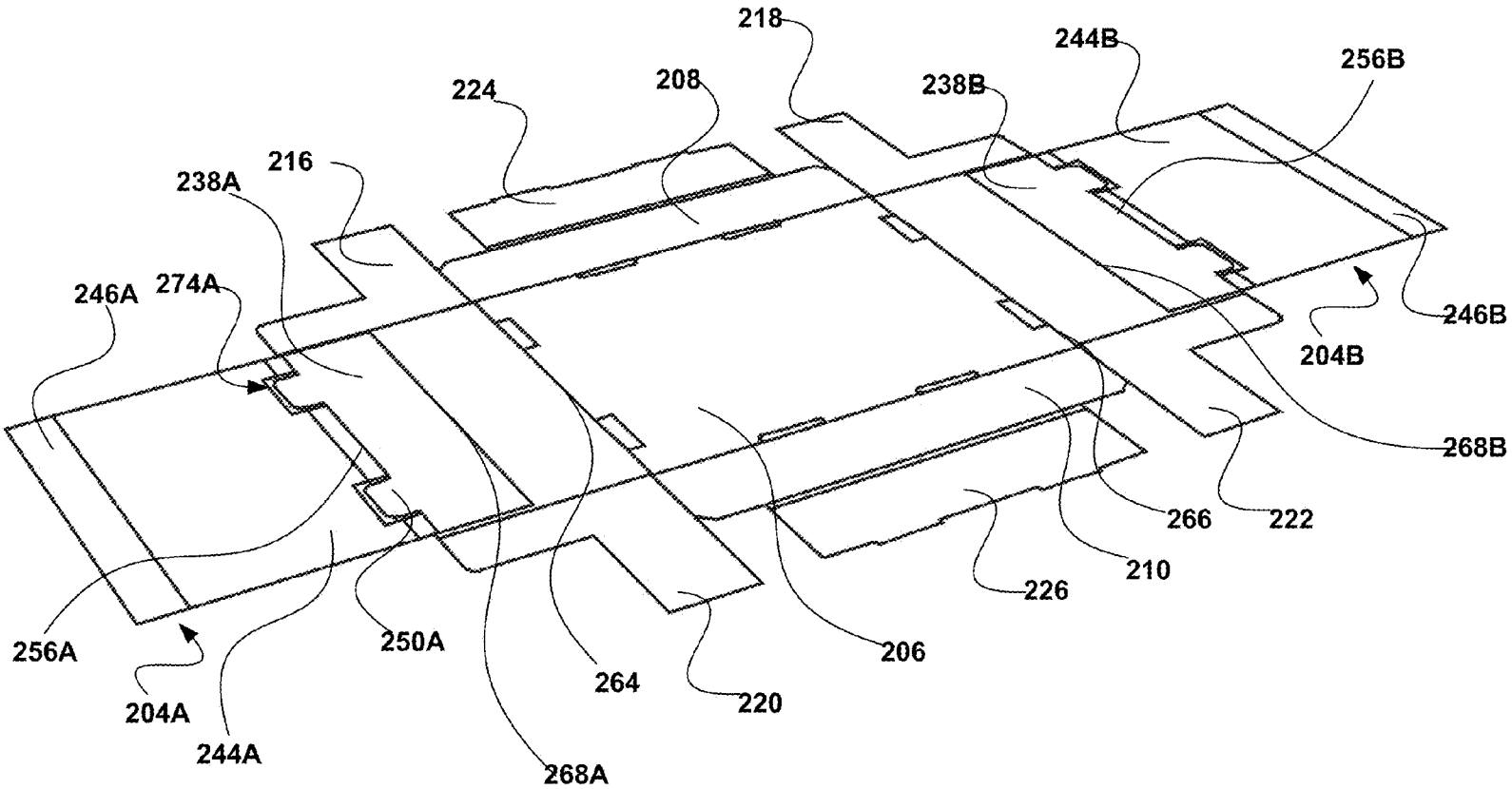
FIG. 13 illustrates the pre-assembly materials for the container of the type illustrated in FIG. 9 in a second stage of pre-assembly.

FIGS. 12 and 13 illustrate the relative placement and interconnectedness of the primary and secondary blanks illustrated in FIGS. 10 and 11 to provide the container illustrated in FIG. 9. Accordingly, as illustrated in FIGS. 12 and 13, the primary and supplementary blanks 202, 204 may be configured so as to interact in a manner that enables the stacking shoulders to be formed easily and quickly as part of the final assembly of the container 200. Accordingly, the total length and width dimensions for the blanks 202, 204 and their constituent panels, walls and sections may be selected so as to facilitate the positioning of the supplementary blanks 204 with respect to the interior of the assembled primary blank 202.

In one potential implementation, one or more portions of the primary and supplementary blanks 202, 204 may be affixed to one another via, for example, adhesive such as glue, staples, tape, etc. so as to produce a preassembly (e.g., a knockdown or preassembly for the container illustrated in FIG. 9), wherein the positioning of supplementary blank 204 in cooperation with primary blank 202 is controlled. For example, the primary and supplementary blanks 202, 204 may be affixed to each other on their mating faces (e.g., the bottom face of supplementary blanks 204 and the top face of the primary blank 202). More specifically, adhesive may be applied to that portion of the second major sections 238A, 238B of the supplementary blanks 204A, 204B that mate with the end panels 214, 212 of the primary blank 202.

Subsequently, the section 238A of supplementary blank 204A and section 238B of supplementary blank 204B may be placed in contact with end panels 214, 212, respectively, during preassembly manufacture. As a result of such a process, a preassembly may be provided that which, when utilized, results in a container having an interior formed primarily by a primary blank 202 serving as an exterior of the container, the interior including a plurality of stacking shoulders formed by supplementary blanks 204 at opposing ends of the container interior, wherein the plurality of stacking shoulders are formed as part of the set up or final assembly of exterior of the container.

Thus, it should be appreciated that, as a first operation in manufacturing the preassembly for the container 200, the faces of the primary and supplementary blanks 202, 204 are affixed together at various locations. As a result, the preassembly illustrated in FIG. 13 is provided by the adherence of the primary and supplementary blanks 202, 204 to one another via adhesive but the panels, walls, etc. are not configured for final assembly. The resulting preassembly may be delivered to a location for final assembly and placement of product; such a preassembly may be effectively and easily stacked with other preassemblies because such preassemblies are flat having not yet been built or assembled as shown in FIG. 9.

Figure 14:
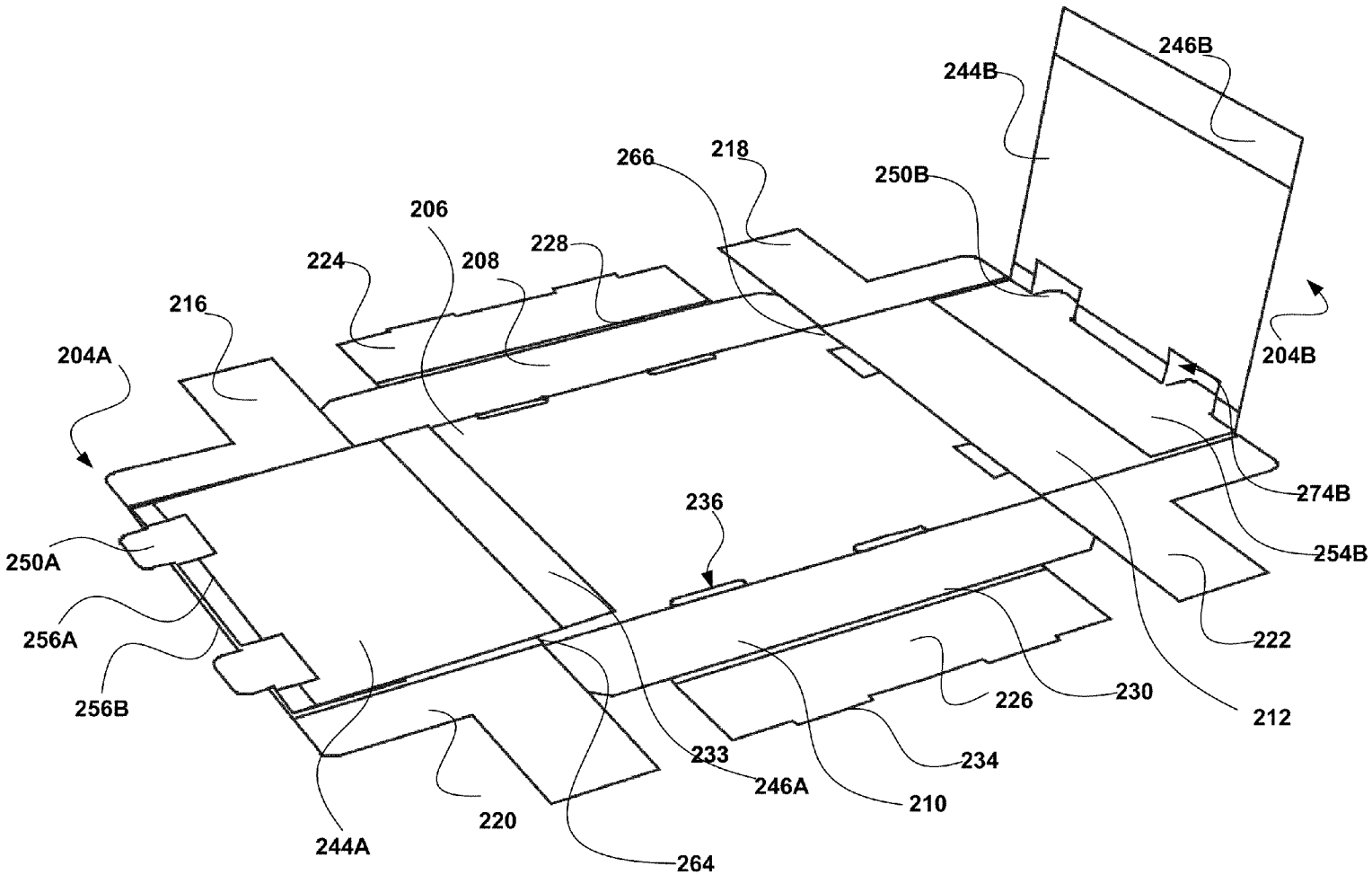
FIG. 14 illustrates the pre-assembly materials for the container of the type illustrated in FIG. 9 in a third stage of pre-assembly.

FIG. 14 illustrates a side perspective of the preassembly manufactured from the blanks illustrated in FIG. 12 during final assembly. As shown in FIG. 14, the supplementary blanks 204 affixed to the primary blank 202 are located such that the second major sections 244A-B of the supplementary blanks 204A-B may be folded towards the first major sections 238A-B along fold lines 258A-B respectively during final assembly. As a result of this folding, one face of each of the first major sections 238A-B meets a face of the corresponding second major sections 244A-B. Additionally, a face of each of the second sub-sections 246A-B meets the bottom panel 206 of the primary blank 202. Prior to this folding, adhesive has been applied to the face of each of the second sub-sections 246A-B meeting the bottom panel 206. As a result, when the faces meet the bottom panel 206, the adhesive acts to affix the second sub-sections 246A-B to the bottom panel 206. As a result of the adherence between the primary blank 202 and the supplementary blanks 204A-B a preassembly is provided that lays flat and is configured for shipping to a manufacturing or distribution center for final assembly.

The preassembly illustrated in FIG. 14 may be manipulated to finally assemble the container 200 of FIG. 9 in a manner similar to the first embodiment as illustrated in FIGS. 6-7. More specifically, the end panels 212, 214 are folded towards the bottom panel 206. As a result of this movement and the adherence between the end panels 212, 214 and the corresponding supplementary blanks 204A-B, the supplementary blanks form end walls of the container 200 together with the end panels 212, 214. Additionally, the sub-section pairs 216, 220 and 218, 220 respectively associated with each end panel 212, 214 are positioned so as to enable the pairs to folded so as to align with corresponding front and back sides of the container 200. More specifically, sub-sections 220 and 222 are folded so as to align with the edge between the bottom panel 206 and the front side panel 210; likewise, the sub-sections 216, 218 are folded so as to align with the edge between the bottom panel 206 and the back side panel 208.

Subsequently, the front and back side panels 210, 208 are folded upward along the fold lines separating those panels from the bottom panel 206. Subsequently or simultaneously, the sub-panels 226, 224 are folded along fold lines 230, 228 over the corresponding sub-sections 220, 222 and 216, 218 respectively. The tabs 234 provided on each of the sub-panels 226, 224 are then inserted into the respective apertures 236. This interaction between the tabs 234 and the apertures locks the sub-sections 220, 222 and 216, 218 into place along with the erected front and back side panels 210, 208 to form front and back side walls of the container 200 as shown in FIG. 9.

Like the first illustrated embodiment, the stacking shoulders of the second embodiment are formed at opposing ends of the container 200 by the first and second major sections 238A-B, 244A-B coupled together by the shoulder sections 248A-B respectively. The shoulders are secured in place by the adhesive provided between the 246A-B and the bottom panel 206 as well as the interaction between the sub-sections 216,218 and 220, 222 and the corresponding back and front side panels 208, 210 and associated sub-panels. As a result of the force exerted on the first major sections 238A-B during erection of the end walls, the keys 250A-B are forced to disengage from the shoulder sections 248A-B (having been provided by a perforation during manufacturing of the supplementary blank 238). These illustrated keys 250A-B are configured to interact respectively with the keyhole apertures 233 provided on other non-illustrated containers 200 stacked above the container 200. Likewise, the illustrated keyhole apertures 233 are configured to interact respectively with the keys 250A-B provided on other non-illustrated containers 200 stacked below the container 200.

As a result of such a process, a preassembly may be provided which, when utilized, results in a container having an interior formed primarily by a primary blank serving as the exterior of the container; the container interior includes a plurality of stacking shoulders formed by the supplementary blanks at opposing ends of the container interior, wherein the plurality of stacking shoulders are formed as part of the set up or final assembly of exterior of the container.

Accordingly, the inclusion of stacking shoulders is implemented with minimal effort and deviation from the assembly required for the exterior of the container. Thus, stacking shoulders may be provided with improved ease and consistency as part of final assembly of a container exterior.

Figure 15:
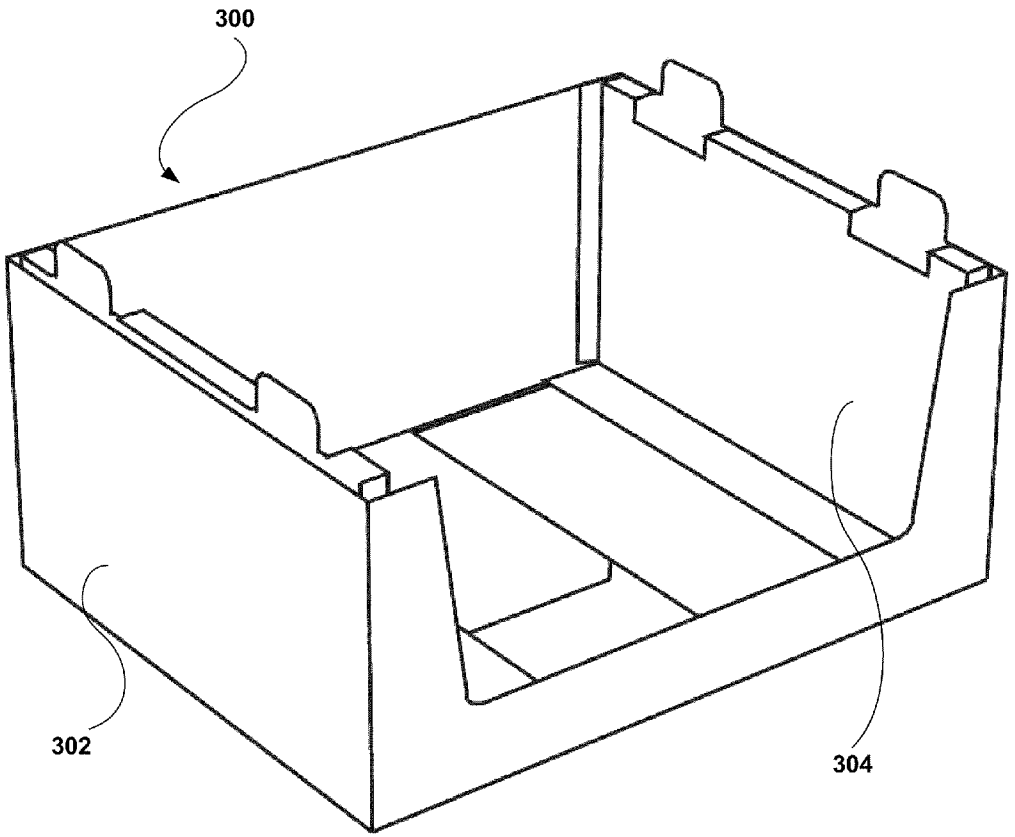
FIG. 15 illustrates a side perspective view of a container manufactured in accordance with an illustrated embodiment.

While this invention has been described in conjunction with the specific embodiments pertaining to a flat bottom container outlined above, it is evident that many alternatives, modifications and variations will be apparent to those skilled in the art. For example, as illustrated in FIG. 15, another example of a container 300 may be a flat bottomed tray container, which may also include a main compartment defined between a plurality of stacking shoulders formed by a corresponding plurality of supplementary blanks 304 and included in an interior space of a primary blank 302 following assembly. As in the first and second illustrated embodiments, these stacking shoulders may be formed by coupling the supplementary blanks 304 to locations on the primary blank 302. The primary differences between the first and second illustrated embodiments and that illustrated in FIG. 15 is that the embodiment of FIG. 15 is a slotted bottom container as opposed to a flat bottom container; like the second embodiment, the container includes a plurality of keys 350 provided on the top of the shoulder and associated keyhole apertures 333 on the bottom side of the container 300.

Accordingly, the container 300 may be used for various purposes including shipping and placement on a display floor along with other such containers in a stack. However, it should be understood that the manufactured container may be any type of container including, for example, any carton, package, box, etc. of any suitable type; accordingly, the actual configurations of the primary blank 302 and the interrelationship with the supplementary blank 304 may change without departing from the scope of the embodiments.

Thus, in accordance with illustrated embodiments, a method is provided of manufacturing containers and resulting containers 300 and associated preassemblies (the combination of 302, 304) and blanks 302, 304, which, when utilized, result in containers 300 that include a plurality of supplementary blanks 304 that provide a plurality of stacking shoulders that serve as a mechanism for improving the stackability of the container 300, whereby the container 300 may be configured to bare larger amounts of force (e.g., weight) applied from a top direction; in addition, the provision of the supplementary blanks 304 may also provide improved strength of the end panels of the resulting container 300 against force applied from side directions.

The container 300 may be used to ship or display product therein in a retail environment. Thus, subsequent to arrival at a retail environment or off-site fulfilment or contract packaging facility, a knockdown version of the container 300 (e.g., a preassembly) may be assembled and product placed in the container 300 for transport and/or display. Because FIG. 9 illustrates a container configured for use as a display container. However, it should be appreciated that additional panels may be included on/attached to the illustrated container for purposes of transporting the container. Accordingly, such panels may be removed from the container to provide the illustrated container of FIG. 15.

Figure 16:
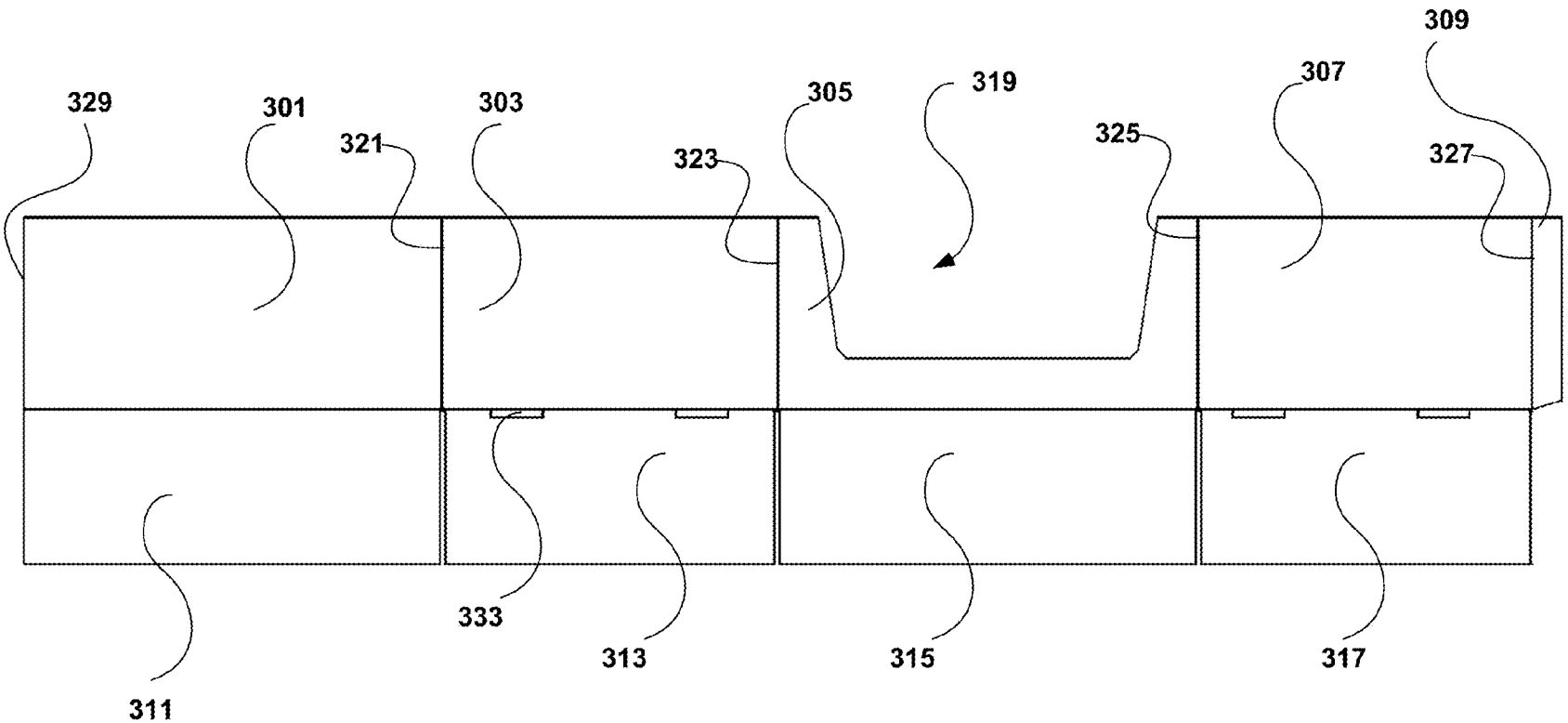
FIG. 16 illustrates an example of a primary blank used in manufacturing the container of the type illustrated in FIG. 15.

FIG. 16 illustrates an example of a primary blank 302, which may be thought of as a conventional tray type container. The knockdown of the container 300 is manufactured by joining the primary blank 302 with a plurality of supplementary blanks 304 (which may be thought of as pads) illustrated in FIG. 17, as explained herein. The primary blank 302 illustrated in FIG. 16 corresponds to the exterior of the container 300 illustrated in FIG. 15; therefore, the container 300 includes primary blank 302 and supplementary blanks 304 illustrated separately in FIG. 11 and in conjunction with primary blank 302 in FIGS. 17-23.

As shown in FIG. 16, the primary blank 302 includes a back side panel 301, end panels 303, 307 and a front side panel 305. The primary blank also includes a plurality of bottom sub-panel 311, 313, 315, 317 that cooperate during final container assembly to form the bottom of the container 300. The back side panel 301 is separated from the first end panel 303 by a fold line 321; likewise, the first side panel 303 is separated from the front side panel 305 by a fold line 323. Similarly, the front side panel 305 is separated from the second end panel 307 by a fold line 325.

The front side panel includes a display aperture 319 that may be formed when a removable shipping section (not shown but including, e.g., a panel covering the top of the container 300 and attached to a panel attached to the front side panel 305) is removed. The primary blank also includes a glue panel 309 provided on a lateral end of the second end panel 307 and separated there from by a fold line 327.

Figure 17:
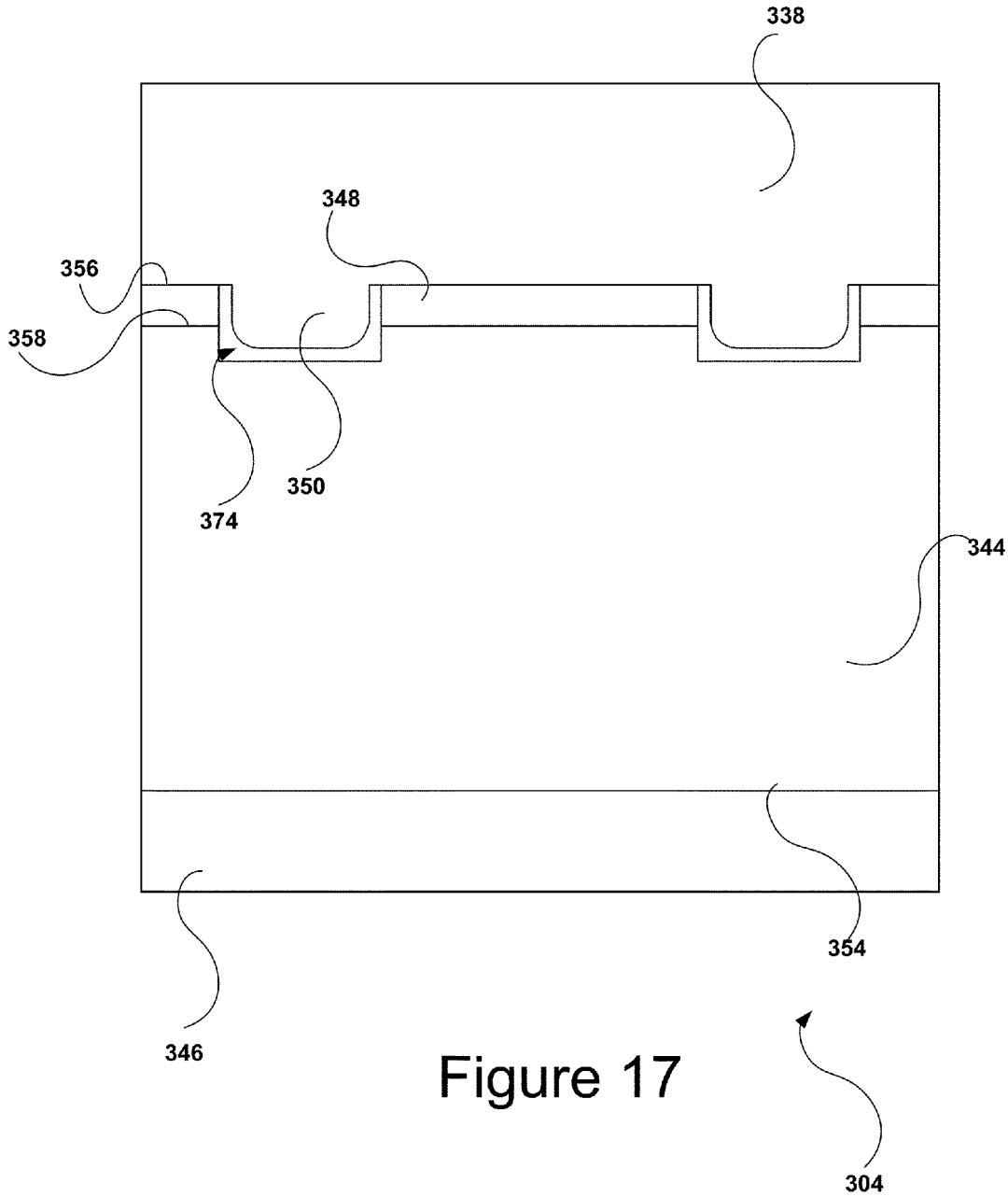
FIG. 17 illustrates an example of a supplementary blank used in manufacturing the container of the type illustrated in FIG. 15.

FIG. 17 illustrates an example of a supplementary blank 304 used in manufacturing the container of the type illustrated in FIG. 15. Like the supplementary blank 204 illustrated in FIG. 11, the supplementary blank 304 includes first and second major sections 338 and 344. The second major section 344 is attached to sub-section 346, which is provided as a point for attaching the supplementary blank 304 to the bottom sub-panels of the primary blank 302 (in particular bottom sub-panels 313 and 317). Likewise, as discussed herein with reference to FIGS. 18-19, first major section 338 is also affixed to an end panel (303 or 307) of the primary blank. 302. Accordingly, during assembly of the container 300, the first major section 344 is folded towards the second major section 338 such that a shoulder section 348 is provided by the folding of the secondary blank 304 along fold lines 356, 358. As an additional result of this folding, the keys 350 are formed on the upper side of the shoulder section 348. As mentioned briefly above and explained in further detail herein, the keys 350 are configured to interact with the keyhole apertures 333 provided on the underside of another container 300 following final assembly.

Figure 18:
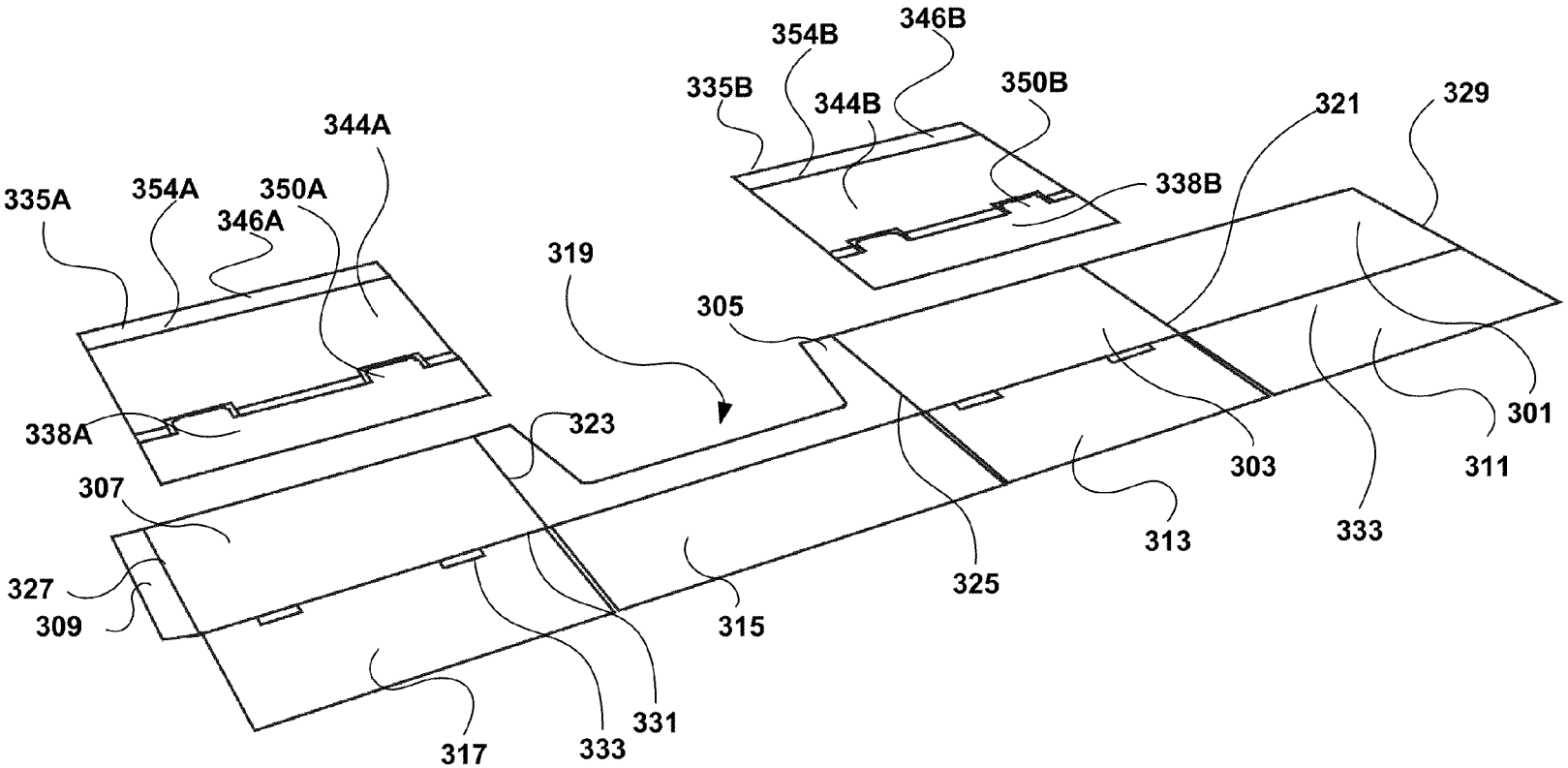
FIG. 18 illustrates the pre-assembly materials for the container of the type illustrated in FIG. 15 in a first stage of pre-assembly.
Figure 19:
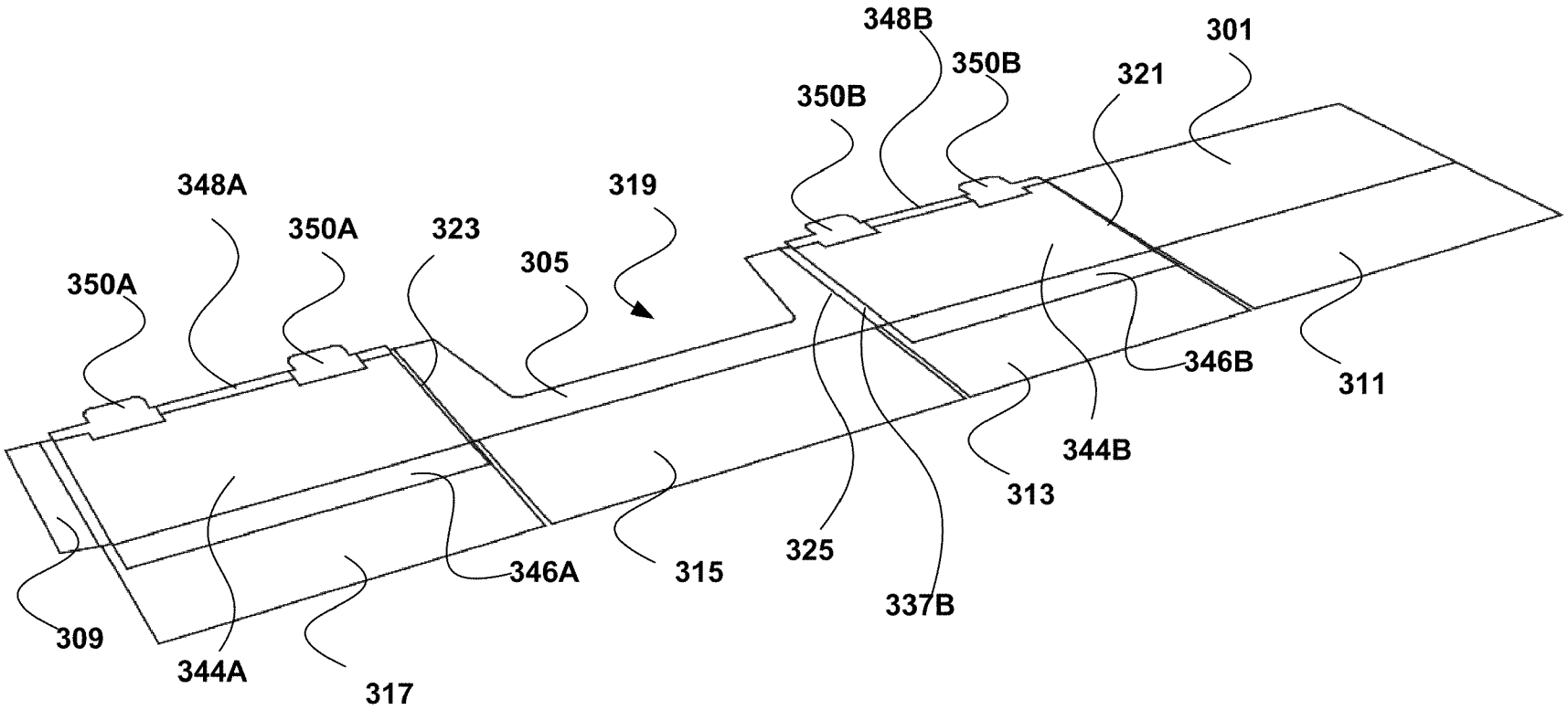
FIG. 19 illustrates the pre-assembly materials for the container of the type illustrated in FIG. 15 in a second stage of pre-assembly.

FIGS. 18 and 19 illustrate the relative placement and interconnectedness of the primary and secondary blanks illustrated in FIGS. 16 and 17 to provide the container illustrated in FIG. 5. Accordingly, as illustrated in FIGS. 18 and 19 (illustrating first and second stages of preassembly manufacture), the primary and supplementary blanks 302, 304 may be configured so as to interact in a manner that enables the stacking shoulders to be formed easily and quickly as part of the final assembly of the container 300. Accordingly, the total length and width dimensions for the blanks 302, 304 and their constituent panels, walls and sections may be selected so as to facilitate the positioning of the supplementary blanks 304 with respect to the interior of the assembled primary blank 304.

In one potential implementation, one or more portions of the primary and supplementary blanks 302, 304 may be affixed to one another via, for example, adhesive such as glue, staples, tape, etc. so as to produce a preassembly (e.g., a knockdown or preassembly for the container illustrated in FIG. 15) such as that illustrated in FIG. 18, wherein the positioning of supplementary blank 304 in cooperation with primary blank 302 is controlled. For example, the primary and supplementary blanks 302, 304 may be affixed to each other on their mating faces (e.g., the bottom face of supplementary blanks 304 and the top face of the primary blank 302). More specifically, adhesive may be applied to that portion of the second major sections 338A, 338B of the supplementary blanks 304A, 304B that mate with the end panels 307, 303 of the primary blank 302. Subsequently, the section 338A of supplementary blank 304A and section 338B of supplementary blank 304B may be placed in contact with end panels 307, 303, respectively, during preassembly manufacture.

Additionally, adhesive may be applied to the top faces of the sub-sections 346A-B illustrated in FIG. 18. Subsequently, the second major sections 344A-B may be folded towards the first major sections 338A-B so that the adhesive covered face of the sub-sections 346A-B contacts and affixes to the bottom sub-panels 317, 313 respectively, as illustrated in FIG. 19.

Figure 20:
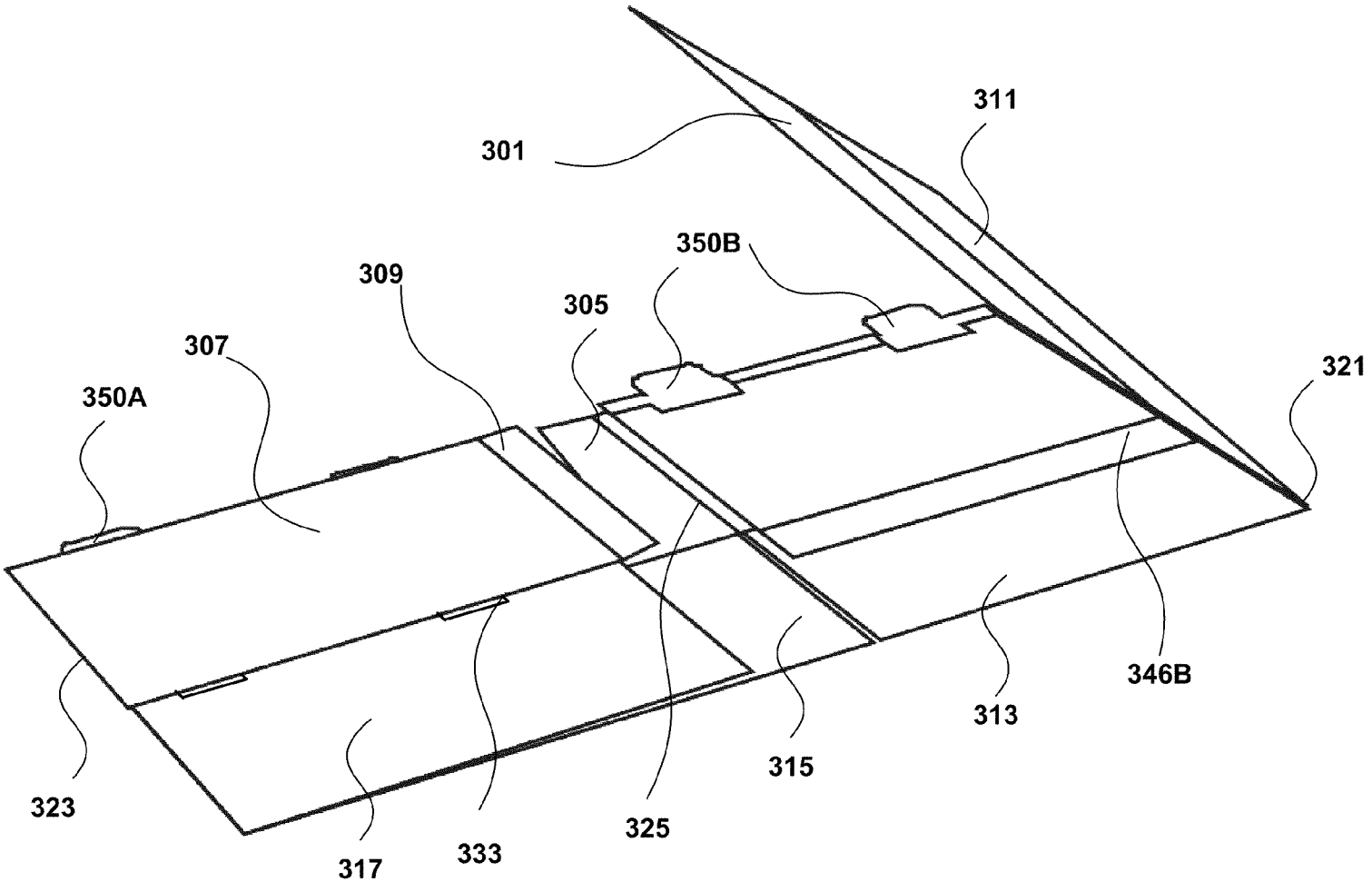
FIG. 20 illustrates the pre-assembly materials for the container of the type illustrated in FIG. 15 in a third stage of pre-assembly.

FIG. 20 illustrates a side perspective of the preassembly manufactured from the blanks illustrated in FIG. 18 in a third stage of preassembly manufacture. As shown in FIG. 20, the supplementary blanks 304 affixed to the primary blank 302 have been located such that the second major sections 344A-B of the supplementary blanks 304A-B have been folded towards the first major sections 338A-B along fold lines 356A-B respectively during the third stage of pre-assembly manufacture.

As shown in FIG. 20, the third stage of pre-assembly manufacture involves first folding the second end panel 307 towards the front side panel 305 along fold line 323 and folding the back side panel 301 towards the second end panel 303 along fold line 321. Adhesive applied to the adhesive panel 309 then comes in contact with the bottom face of the back end panel 301 to join the back end panel 301 to the second end panel 307. As a result, in the preassembly illustrated in FIG. 21, the two fold lines 327, 329 are co-located so as to form one corner of a corresponding container.

Figure 21:
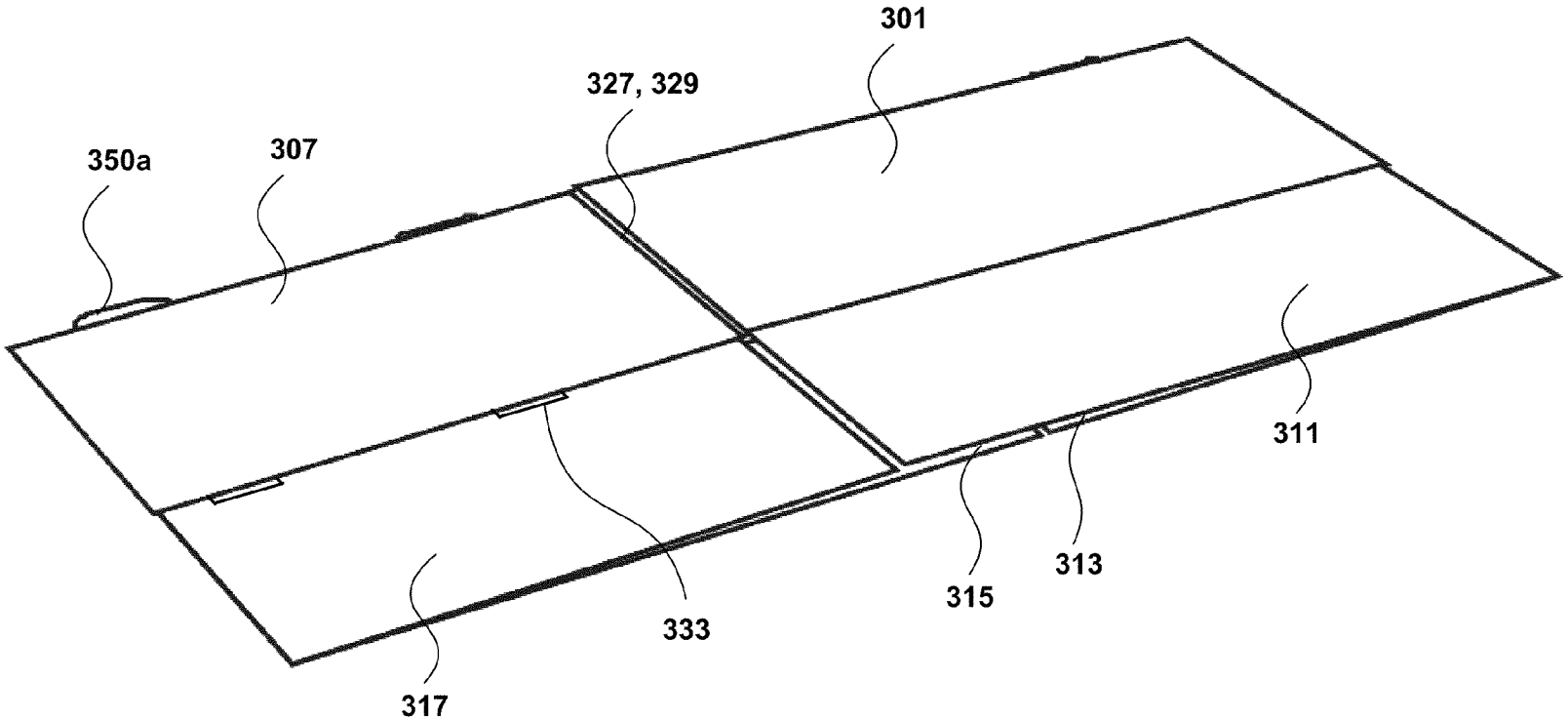
FIG. 21 illustrates the pre-assembly materials for the container of the type illustrated in FIG. 15 in a fourth stage of pre-assembly.

As a result, the preassembly illustrated in FIG. 21 is provided by the adherence of the primary and supplementary blanks 302, 304 to one another via adhesive but the panels, walls, etc. are not configured for final assembly. As a result of such a process, a preassembly may be provided that which, when utilized, results in a container having an interior formed by a primary blank 302 serving as an exterior of the container, the interior including a plurality of stacking shoulders formed by supplementary blanks 304 at opposing ends of the container interior, wherein the plurality of stacking shoulders are formed as part of the set up or final assembly of exterior of the container.

The resulting preassembly may be delivered to a location for final assembly and placement of product; such a preassembly may be effectively and easily stacked with other preassemblies because such preassemblies are flat having not yet been built or assembled as shown in FIG. 15.

Figure 22:
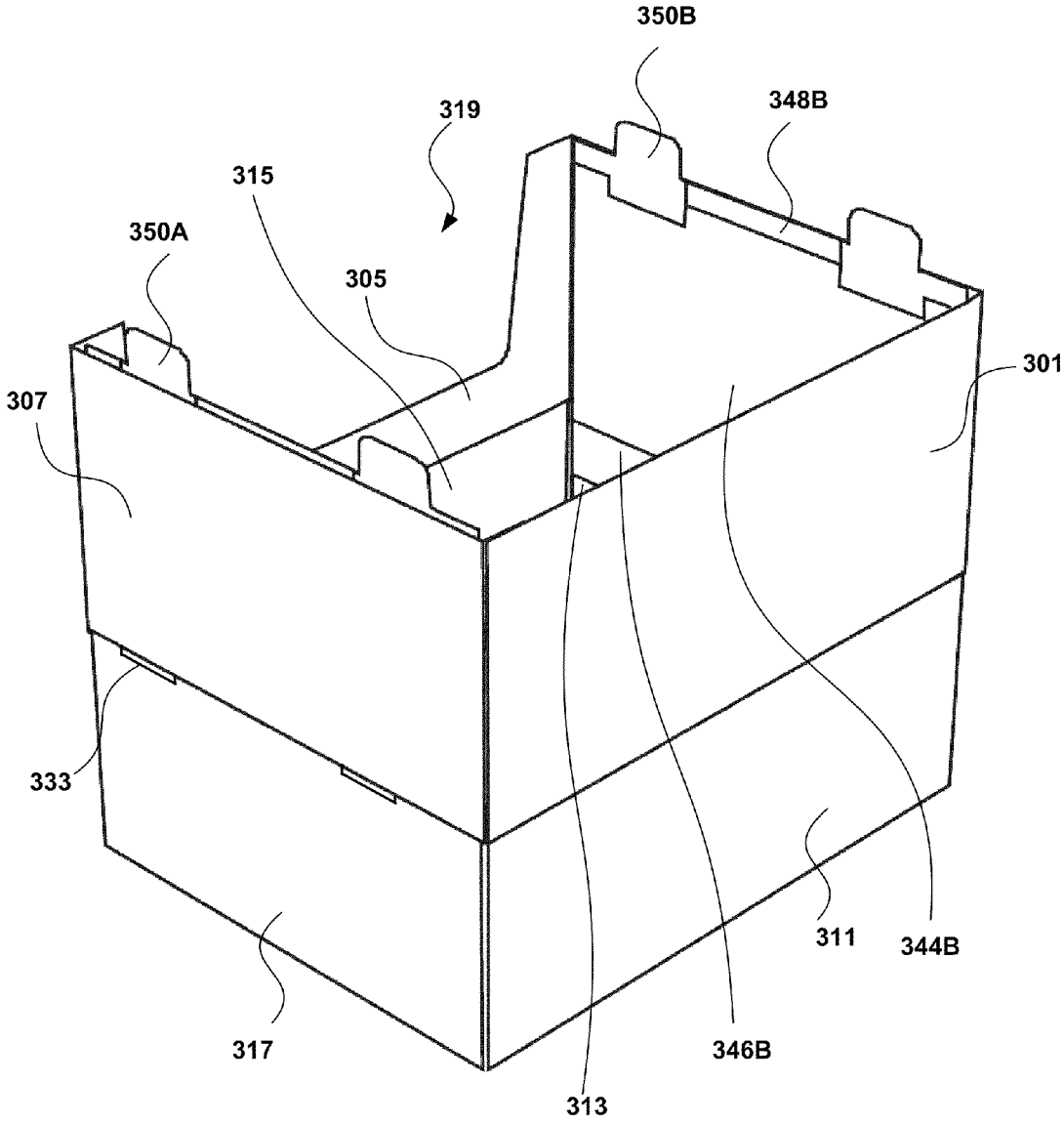
FIG. 22 illustrates the pre-assembly materials for the container of the type illustrated in FIG. 15 in a first stage of final assembly.
Figure 23:
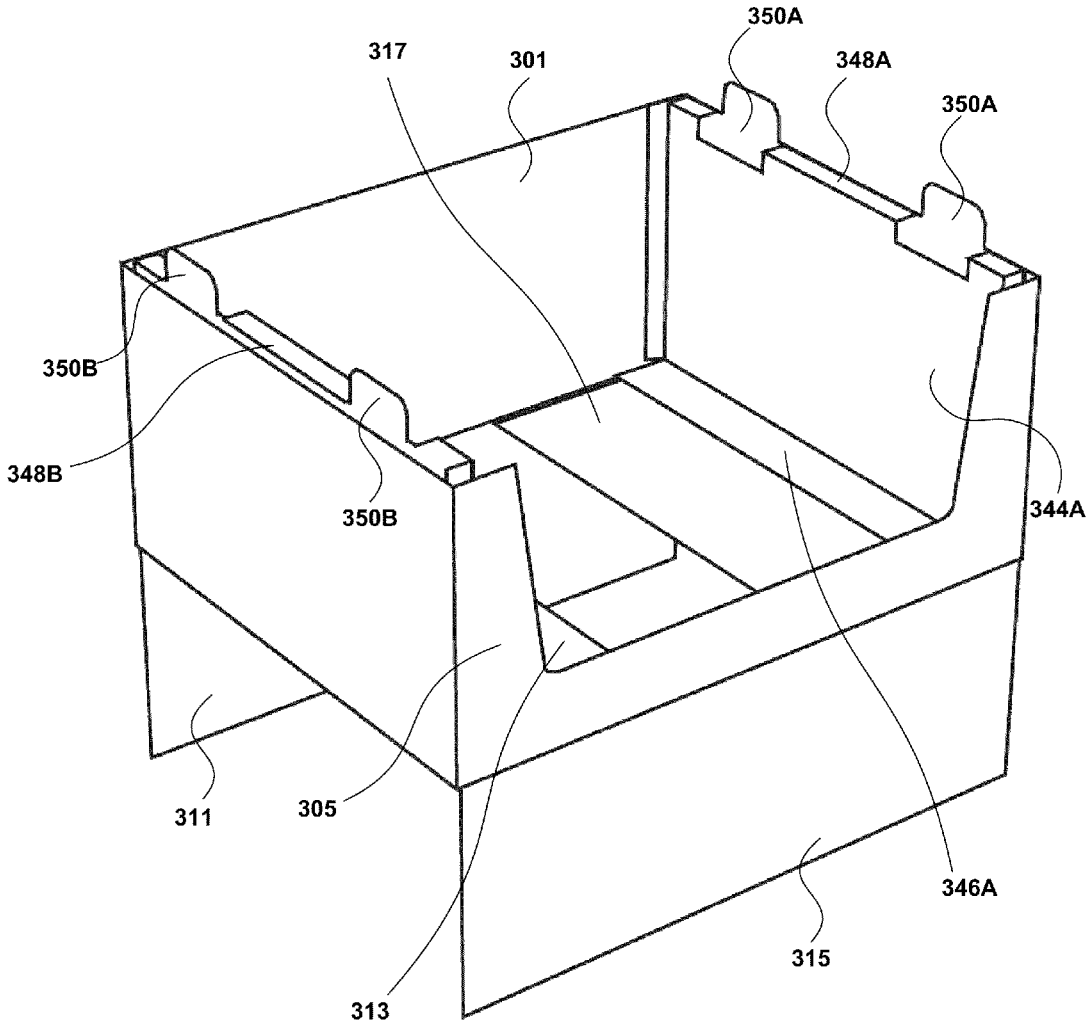
FIG. 23 illustrates the pre-assembly materials for the container of the type illustrated in FIG. 15 in a second stage of final assembly.

FIG. 22 illustrates the preassembly illustrated in FIG. 21 in a first stage of final assembly. During final assembly, the side panels 301, 305 and end panels 303, 307 are manipulated to be parallel to one another respectively and orthogonal therebetween. As a result of this movement, the bottom sub-panels 311, 313, 315 and 317 are positioned to be folded towards one another to form the bottom wall of the container 300. More specifically, first bottom sub-panels 313 and 317 are folded inward towards the interior of the container 300, as shown in FIG. 23. Subsequently, sub-panels 311 and 315 are folded towards the interior of the container 300 to complete the finally assembled container 300. It should be appreciated that the bottom sub-panels 311-317 may be affixed to one another via adhesive, tape, staples or any other conventionally known material or mechanism for adherence.

Like the first and second illustrated embodiments, the stacking shoulders of the third embodiment are formed at opposing ends of the container 300 by the first and second major sections 338A-B, 344A-B coupled together by the shoulder sections 348A-B respectively. The shoulders are secured in place by the adhesive provided between the sub-sections 346A-B and the bottom panel portion formed by 317, 313 as well as the adhesive provided between the first major sections 338A-B and the corresponding end panels 307, 303 of the primary blank 302.

Unlike the first and second illustrated embodiments, the force exerted on the first major sections 238A-B during the folding over of the second major sections 244A-B forces the keys 250A-B to disengage from the shoulder sections 248A-B (having been provided by a perforation during manufacturing of the supplementary blank 238). However, like the first and second embodiments, the formation of the shoulder sections at opposing ends of the container 300 does not occur until final assembly of the container. This is because the shoulders are not formed including shoulder sections 348A-B until the bottom sub-panels 313, 317 are folded towards the interior of the container 300 because the sub-sections 346A-B are affixed to the bottom panels 313, 317. These illustrated keys 350A-B are configured to interact respectively with the keyhole apertures 333 provided on other non-illustrated containers 300 stacked above the container 300. Likewise, the illustrated keyhole apertures 333 are configured to interact respectively with the keys 350A-B provided on other non-illustrated containers 300 stacked below the container 300.

As a result of such a process, a preassembly may be provided which, when utilized, results in a container having an interior formed primarily by a primary blank serving as the majority of the exterior of the container; the container interior includes a plurality of stacking shoulders formed by the supplementary blanks at opposing ends of the container interior, wherein the plurality of stacking shoulders are formed as part of the set up or final assembly of exterior of the container.

Accordingly, the inclusion of stacking shoulders is implemented with minimal effort and deviation from the assembly required for the exterior of the container. Thus, stacking shoulders may be provided with improved ease and consistency as part of final assembly of a container exterior.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

For example, various illustrated features of the preassembly and resulting containers may be omitted. Furthermore, it should be understood that invention embodiments are capable of variations practiced or carried out in various ways. Therefore, it should be appreciated that, in accordance with at least one embodiment of the invention, any and all of the walls may be constructed of corrugated cardboard. However, it should be understood that the walls, panels, any tabs on various panels, etc., may be constructed of various industry recognized appropriate materials that meet various transporting and/or display criteria. As a result, it should be understood that containers manufactured in accordance with at least one embodiment of the invention may also be considered "cartons," which may be considered packaging or display containers, commonly made from cardstock or cardboard. Further, it should be understood that cartons come in many different varieties but most cartons can be folded and assembled from a flat form, known as a carton blank. Thus, it should be understood that the pattern for any blank, preassembly or container may be different than those described herein.

Alternatively, or more specifically, the packaging and/or display containers may be made using corrugated board, e.g., material made by a corrugator (a machine that produces corrugated board by attaching fluting to liners) which is a structured board formed by gluing one or more arched layers of corrugated medium to one or more flat-facing linerboards.

It should be understood that implementation of the method and system of the present invention involves performing or completing certain selected tasks or steps manually, automatically, or a combination thereof.

Additionally, it should be appreciated that material used in accordance with at least one embodiment of the invention may be laminated to provide barrier properties. Further, other barrier materials may be used including Ultra Violet (UV), moisture and gas barriers. Additionally, though not discussed in detail herein, it should be understood that any adhesive used to provide a bond between materials used in containers provided in accordance with the invention may include any substance that helps bond two materials together, examples including but not limited to glue and paste.

Further, it should be appreciated that the material used to form the primary blank may be different, stronger, or weaker than the blank used to form the supplementary blank. Thus, for example, use of a supplementary blank that is of a heavier, more durable or stronger material than the material used for primary blank, may provide the increased ease of final assembly as well as increased durability or strength to the resulting container while reducing the amount of material in the container (something of interest for environmental and cost issues).

It should also be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Additionally, it should be understood that the functionality described in connection with various described components of various invention embodiments may be combined or separated from one another in such a way that the structure of the invention is somewhat different than what is expressly disclosed herein.

For example, it should be understood that, unless otherwise specified, there is no essential requirement that methodology operations be performed in the illustrated order; therefore, one of ordinary skill in the art would recognize that some operations may be performed in one or more alternative order and/or simultaneously.

Moreover, it should be appreciated that the supplementary blank and/or resulting stacking shoulders may be, for example, may have a shape that is different than that illustrated in FIG. 1, for example, relative dimensions may be different and/or varied at various points along the interior of the container. Likewise, various alternative configurations for both the primary and supplementary blanks may be implemented without deviating from the inventive concept.

Additionally, it should be appreciated that although a plurality of supplementary blanks may be provided at opposing ends of a container, it is foreseeable that a single supplementary blank may be included.

Further, the disclosure of application of adhesive on a surface of a blank to provide adherence with a panel of the primary blank or a section of the supplementary blank is not critical; rather, adhesive may, instead, be applied on the panel or section to which the surface is to be affixed. Therefore, placement of adhesive on one surface or the other, mating, surface is not critical.

It should be apparent for those skilled in the art that the illustrative embodiments described are only examples and that various modifications can be made within the scope of the invention as defined in the appended claims.

The invention claimed is:

1. A method of manufacturing a container, the method comprising:

cutting a primary blank including a plurality of lateral panels and at least one bottom panel configured to provide an exterior of the container;

cutting a plurality of supplementary blanks each including a plurality of major sections and at least one sub-section; and affixing one of the major sections of each supplementary blank to the corresponding opposing lateral panel of the primary blank and the at least one sub-section of each supplementary blank to the at least one bottom panel of the primary blank, wherein as the container is finally assembled, an exterior of the container is formed by the plurality of lateral panels and the at least bottom panel of the primary blank, and wherein a plurality of stacking shoulders are formed automatically by movement of the primary blanks causing movement of the supplementary blanks at opposing lateral panels of an interior of the container, and the plurality of stacking shoulders are formed as part of the final assembly of the primary blank as the exterior of the container.

2. The method of claim 1, wherein the plurality of lateral panels of the primary blank include a front side panel, back side panel and first and second end panels.

3. The method of claim 2, wherein one of the major sections of each of the plurality of supplementary blanks is affixed to either a first end panel or a second end panel of the plurality of lateral panels of the primary blank.

4. The method of claim 1, wherein the supplementary blanks each includes a plurality of keys, each configured to be erected upon one of the stacking shoulders as the stacking shoulders are formed during final assembly of the primary blank as the exterior of the container.

5. The method of claim 1, wherein the container includes a plurality of keyhole apertures on the at least one lateral panel of the primary blank following final assembly of the primary blank as the exterior of the container.

6. The method of claim 1, wherein the primary blank is affixed to the supplementary blanks via application of an adhesive.

7. A container preassembly comprising:

a primary blank including a plurality of lateral panels and at least one bottom panel configured to provide an exterior of the container; and a plurality of supplementary blanks each including a plurality of major sections and at least one sub-section, wherein one of the major sections of each supplementary blank is affixed to a corresponding opposed lateral panel of the primary blank and the at least one sub-section of each supplementary blank is affixed to the at least one bottom panel of the primary blank such that, as the container is finally assembled, an exterior of the container is formed by the plurality of lateral panels and the at least one bottom panel of the primary blank, and wherein a plurality of stacking shoulders are formed automatically by movement of the primary blanks causing movement of the supplementary blanks at opposing lateral panels of an interior of the container, and the plurality of stacking shoulders are formed as part of the final assembly of the primary blank as the exterior of the container.

8. The container preassembly of claim 7, wherein the plurality of lateral panels of the primary blank include a front side panel, back side panel and first and second end panels.

9. The container preassembly of claim 8, wherein one of the major sections of each of the plurality of supplementary blanks is affixed to either a first end panel or a second end panel of the plurality of lateral panels of the primary blank.

10. The container preassembly of claim 7, wherein the supplementary blanks each includes a plurality of keys, each configured to be erected upon one of the stacking shoulders as the stacking shoulders are formed during final assembly of the primary blank as the exterior of the container.

11. The container preassembly of claim 8, wherein the primary blanks includes a plurality of keyhole apertures on at least of the lateral panels of the primary blank following final assembly of the primary blank as the exterior of the container.

12. The container preassembly of claim 8, wherein the primary blank is affixed to the supplementary blanks via application of an adhesive.

13. A plurality of blanks for a container preassembly, the plurality of blanks comprising:

a primary blank including a plurality of lateral panels and at least one bottom panel configured to provide an exterior of the container; and a plurality of supplementary blanks each including a plurality of major sections and at least one sub-section, wherein the primary blank is configured to mate with and be affixed to the supplementary blank so that one of the major sections of each supplementary blank is affixed to the corresponding opposed lateral panel of the primary blank and the at least one sub-section of each supplementary blank is affixed to the at least one bottom panel of the primary blank such that, as the container is finally assembled, an exterior of the container is formed by the plurality of lateral panels and the at least one bottom panel of the primary blank, and wherein a plurality of stacking shoulders are formed automatically by movement of the primary blanks causing movement of the supplementary blanks at opposing lateral panels of an interior of the container, and the plurality of stacking shoulders are formed as part of the final assembly of the primary blank as the exterior of the container.

14. The plurality of blanks of claim 13, wherein the supplementary blacks each includes a plurality of keys, each configured to be erected upon one of the stacking shoulders as the stacking shoulders are formed during final assembly of the primary blank as the exterior of the container.

15. The plurality of blanks of claim 13, wherein the primary blank includes a plurality of keyhole apertures on at least one of the lateral panels of the primary blank following final assembly of the primary blank as the exterior of the container.

16. The method of claim 1, wherein the supplemental blanks each includes first and second major sections joined by a shoulder section, and the first major section is affixed to the lateral panel of the primary blank and the at least one sub-section extends from the second major section.

17. The method of claim 16, wherein the supplemental blanks each includes lateral sub-sections extending from a respective lateral edge of the second major section and the lateral sub-sections lie adjacent a corresponding adjacent lateral panel of final assembly of the primary blank.

18. The method of claim 16, wherein the first and second major sections of the supplemental blanks have a height greater than the height of the lateral panel to which the first major section is affixed.

19. The method of claim 16, wherein the first major section of the supplemental blanks has a height less than the height of the second major section and the height of the lateral panel to which the first major section is affixed.

20. The container preassembly of claim 7, wherein the supplemental blanks each includes first and second major sections joined by a shoulder section, and the first major section is affixed to the lateral panel of the primary blank and the at least one sub-section extends from the second major section.

21. The container preassembly of claim 20, wherein the supplemental blanks each includes lateral sub-sections extending from a respective lateral edge of the second major section and the lateral sub-sections lie adjacent a corresponding adjacent lateral panel of final assembly of the primary blank.

22. The container preassembly of claim 20, wherein the first and second major sections of the supplemental blanks have a height greater than the height of the lateral panel to which the first major section is affixed.

23. The container preassembly of claim 20, wherein the first major section of the supplemental blanks has a height less than the height of the second major section and the height of the lateral panel to which the first major section is affixed.

24. The plurality of blanks of claim 13, wherein the supplemental blanks each includes first and second major sections joined by a shoulder section, and the first major section is to be affixed to the lateral panel of the primary blank and the at least one sub-section extends from the second major section.

25. The plurality of blanks of claim 24, wherein the supplemental blanks each includes lateral sub-sections extending from a respective lateral edge of the second major section and the lateral sub-sections are configured to lie adjacent a corresponding adjacent lateral panel of final assembly of the primary blank.

26. The plurality of blanks of claim 24, wherein the first and second major sections of the supplemental blanks have a height greater than the height of the lateral panel to which the first major section is to be affixed.

27. The plurality of blanks of claim 24, wherein the first major section of the supplemental blanks has a height less than the height of the second major section and the height of the lateral panel to which the first major section is to be affixed.

* * * * *